US009952530B2

(12) United States Patent
Kubo

(10) Patent No.: US 9,952,530 B2
(45) Date of Patent: Apr. 24, 2018

(54) IMAGE FORMING APPARATUS

(71) Applicant: CANON KABUSHIKI KAISHA, Tokyo (JP)

(72) Inventor: Norihiko Kubo, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/099,671

(22) Filed: Apr. 15, 2016

(65) Prior Publication Data

US 2016/0320733 A1 Nov. 3, 2016

(30) Foreign Application Priority Data

Apr. 28, 2015 (JP) ..... 2015-091671

(51) Int. Cl.

*G03G 15/09* (2006.01)
*G03G 15/06* (2006.01)
*G03G 15/00* (2006.01)

(52) U.S. Cl.

CPC ..... *G03G 15/065* (2013.01); *G03G 15/0907* (2013.01); *G03G 15/50* (2013.01); *G03G 2215/0129* (2013.01)

(58) Field of Classification Search

None

See application file for complete search history.

(56) References Cited

U.S. PATENT DOCUMENTS 5,771,423 A * 6/1998 Hama ..... G03G 15/0907 399/235
8,005,380 B2 8/2011 Kubo
8,170,433 B2 5/2012 Kubo
8,843,032 B2 9/2014 Kubo
2005/0185975 A1* 8/2005 Kobayashi ..... G03G 15/0844 399/44
2010/0028033 A1* 2/2010 Miura ..... G03G 15/0856 399/66
2010/0247120 A1* 9/2010 Murata ..... G03G 21/203 399/43
2010/0290799 A1* 11/2010 Komiya ..... G03G 15/5033 399/49
2011/0116816 A1* 5/2011 Uetake ..... G03G 15/0862 399/27

(Continued)

FOREIGN PATENT DOCUMENTS

JP 2001-194909 A 7/2001
JP 2010-134205 A 6/2010

(Continued)

*Primary Examiner* — Sevan A Aydin
(74) *Attorney, Agent, or Firm* — Fitzpatrick, Cella, Harper & Scinto

(57) ABSTRACT

A developing unit includes a developer bearing member that rotates and bears a developer including a toner and a carrier. A controller switches between a first mode and a second mode based on information which influences a toner charging amount. In the first mode, the developer bearing member rotates during a predetermined operation period from a command of an image forming operation until start of forming the electrostatic latent image. Meanwhile, in the second mode, a total number of rotations of the developer bearing member during the predetermined operation period is smaller than that in the first mode.

8 Claims, 13 Drawing Sheets

(56) References Cited

U.S. PATENT DOCUMENTS

| | | | | |
|---|---|---|---|---|
| 2014/0169804 | A1* | 6/2014 | Suzuki | G03G 15/0136 399/26 |
| 2016/0282773 | A1* | 9/2016 | Ishida | G03G 15/1605 |
| 2016/0291507 | A1* | 10/2016 | Nakayama | G03G 15/0849 |
| 2016/0320733 | A1* | 11/2016 | Kubo | G03G 15/065 |

FOREIGN PATENT DOCUMENTS

| | | | |
|---|---|---|---|
| JP | 2010-156911 | A | 7/2010 |
| JP | 2012-128320 | A | 7/2012 |

* cited by examiner

IMAGE FORMING APPARATUS

BACKGROUND OF THE INVENTION

Field of the Invention

This disclosure relates to an image forming apparatus such as a copier, a printer, a facsimile, or multi-function printer having a plurality of functions, in which an electro-photographic system or an electrostatic recording system is used.

Description of the Related Art

Hitherto, in an image forming apparatus configured to form an image by a toner such as an electro-photographic type image forming apparatus, a two-component developing system using a two-component developer that is composed of mainly mixing the toner and a carrier is widely used. In the image forming apparatus, the two-component developer is borne onto a developing sleeve which is a developer bearing member, and the toner in the two-component developer is supplied to a photosensitive drum which is an image bearing member. A surface of the photosensitive drum is charged to a predetermined charge potential, and an electrostatic latent image is formed by exposing the surface. In addition, by applying a predetermined development voltage to the developing sleeve, the toner which is charged to the same polarity as charge polarity of the photosensitive drum is adhered to the electrostatic latent image, and a toner image is formed.

Here, it is desirable that a difference (Vback) between a potential (Vd) on the photosensitive drum of a non-image portion in which the electrostatic latent image is not formed, and a value (Vdc) of a DC component of the development voltage applied to the developing sleeve, is controlled to be within a predetermined range. That is, "carrier adhesion" occurs in which the carrier in the two-component developer borne on the developing sleeve is adhered to the photosensitive drum when Vback is large, and on the contrary, a so-called "fogging" occurs in which the toner is adhered to the non-image portion of the photosensitive drum when Vback is small. In particular, since there is a possibility that the surface of the photosensitive drum is damaged when the carrier adhesion occurs, in the related art, Vback is controlled to suppress the occurrence of the carrier adhesion.

It is desirable that the relationship of Vback is maintained when the voltage falls when application of each voltage is stopped in response to completion of image formation, and when the voltage rises when application of each voltage is started in response to start of the image formation. In particular, in the case where the voltage falls, in order to reduce the carrier adhesion to the photosensitive drum, a development voltage and a charge voltage fall after rotation of the developing sleeve is stopped. Here, after the rotation of the developing sleeve is stopped, when Vback is applied between the developing sleeve and the photosensitive drum, there is a case where a phenomenon occurs in which the toner in the developer on the developing sleeve is adhered to the developing sleeve due to the influence of an electric field. When the toner adhesion to the developing sleeve occurs, a belt-like image (abnormal image) is generated at a sleeve pitch in the next output image. Therefore, JP-A-2010-134205 suggests controlling Vback in order to reduce the toner adhesion to the developing sleeve.

SUMMARY OF THE INVENTION

This disclosure is to provide a configuration in which generation of an abnormal image due to toner adhesion to a developer bearing member is suppressed, and deterioration of a developer or deterioration of service life of a developing unit is suppressed.

According to a first aspect of this disclosure, there is provided an image forming apparatus including a rotating image bearing member, a charging unit configured to charge a surface of the image bearing member to a charge potential, a latent image forming unit configured to form an electrostatic latent image on the surface of the image bearing member charged by the charging unit, a developing unit including a developer bearing member configured to rotate and to bear a developer including a toner and a carrier, the developing unit configured to develop the electrostatic latent image formed on the surface of the image bearing member by the toner by applying a development voltage to the developer bearing member, and a controller configured to stop charging of the charging unit and an application of the development voltage after stopping a rotation of the developer bearing member in response to completion of an image formation, the controller being able to perform a first mode in which the developer bearing member rotates during a predetermined operation period from a command of an image forming operation until start of forming the electrostatic latent image by the latent image forming unit, and a second mode in which a total number of rotations during the predetermined operation period is smaller than that in the first mode, the controller switching the first mode and the second mode based on information which influences a toner charging amount.

According to a second aspect of this disclosure, there is provided an image forming apparatus including a rotating image bearing member, a charging unit configured to charge a surface of the image bearing member to a charge potential, a latent image forming unit configured to form an electrostatic latent image on the surface of the image bearing member charged by the charging unit, a developing unit including a developer bearing member configured to rotate and to bear a developer including a toner and a carrier, the developing unit configured to develop the electrostatic latent image formed on the surface of the image bearing member by the toner by applying a development voltage to the developer bearing member, and a controller configured to start a rotation of the developer bearing member after starting charge by the charging unit and an application of the development voltage in response to start of an image formation, the controller being able to perform a first mode in which the developer bearing member rotates during a predetermined operation period from a command of an image forming operation until start of forming the electrostatic latent image by the latent image forming unit, and a second mode in which a total number of rotations during the predetermined operation period is smaller than that in the first mode, the controller switching the first mode and the second mode based on information which influences a toner charging amount.

Further features of the present invention will become apparent from the following description of exemplary embodiments with reference to the attached drawings.

DESCRIPTION OF THE EMBODIMENTS

First Embodiment

A first embodiment will be described by using FIGS. 1 to 8. First, a schematic configuration of an image forming apparatus of the embodiment will be described by using FIGS. 1 to 3.

Image Forming Apparatus

An image forming apparatus 100 of the embodiment is a color laser printer in which a transfer type electro-photographic process, a contact charge type, and a reverse developing type are used, and the maximum paper size is an A3 size. The image forming apparatus 100 forms and outputs a color image to a recording medium (for example, a sheet material, such as a paper sheet or an OHP sheet) in accordance with image information from an external host apparatus, such as a personal computer or an image reading apparatus which is connected to be communicable with an apparatus body.

Figure 1:
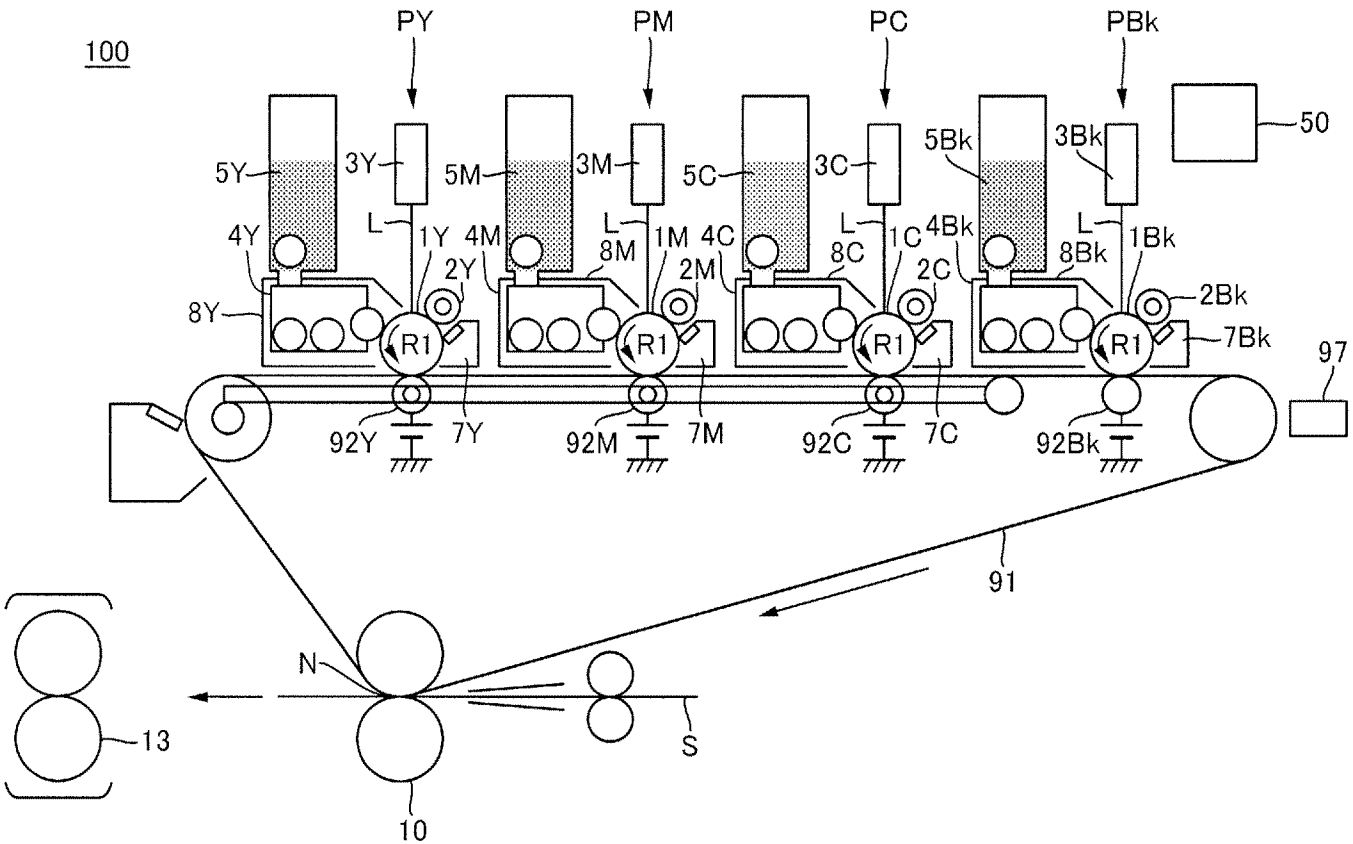
FIG. 1 is a schematic configuration sectional view of an image forming apparatus according to a first embodiment.

As illustrated in FIG. 1, the image forming apparatus 100 is a so-called tandem type image forming apparatus in which a plurality of image forming portions are disposed to be aligned along the moving direction of an intermediate transfer belt (intermediate transfer body) 91. In other words, the image forming apparatus 100 includes a plurality of process cartridges 8Y, 8M, 8C, and 8Bk, and continuously transfers toner images to the movable intermediate transfer belt 91 so as to superimpose each other by the process cartridges 8Y, 8M, 8C, and 8Bk. After this, a color image is formed by transferring the toner images at the same time to a recording medium S from the intermediate transfer belt 91. In the embodiment, four process cartridges 8Y, 8M, 8C, and 8Bk are disposed in an order of yellow, magenta, cyan, and black in series in the moving direction of the intermediate transfer belt 91. Hereinafter, this will be described in more detail.

The image forming apparatus 100 includes first, second, third, and fourth image forming portions PY, PM, PC, and PBk for forming images having each of the colors, such as yellow (Y), magenta (M), cyan (C), and black (Bk). Since four image forming portions PY, PM, PC, and PBk include the same configuration, except that the colors of developers used are different from each other, hereinafter, a first image forming portion PY will be mainly described, and overlapped description regarding other image forming portions PM, PC, and PBk will be omitted.

For example, when describing the entire operation of a case where images of four colors are formed, according to a signal from the external host apparatus which is connected to be communicable with the image forming apparatus 100, a color-separated image signal is generated. In accordance with the signal, toner images of each color are formed in each of process cartridges 8Y, 8M, 8C, and 8BK of each of the image forming portions PY, PM, PC, and PBk.

The process cartridge 8Y includes a rotatable drum type electro-photographic photosensitive member (photoconductor) which includes an organic material photosensitive layer on a conductive supporting body as an image bearing member, that is, a photosensitive drum 1Y. A surface of the photosensitive drum 1Y is charged to a charge potential as a predetermined charge voltage is applied to a charging roller 2Y which serves as a charging unit. By scanning and exposing the uniformly charged surface by an exposing unit (for example, a laser beam scanner) 3Y which serves as a latent image forming unit, an electrostatic latent image (electrostatic image) is formed on the photosensitive drum 1Y. In addition, by supplying a toner which is a developer by a developing unit 4Y to the electrostatic latent image, a toner image is formed on the surface of the photosensitive drum 1Y.

Figure 2:
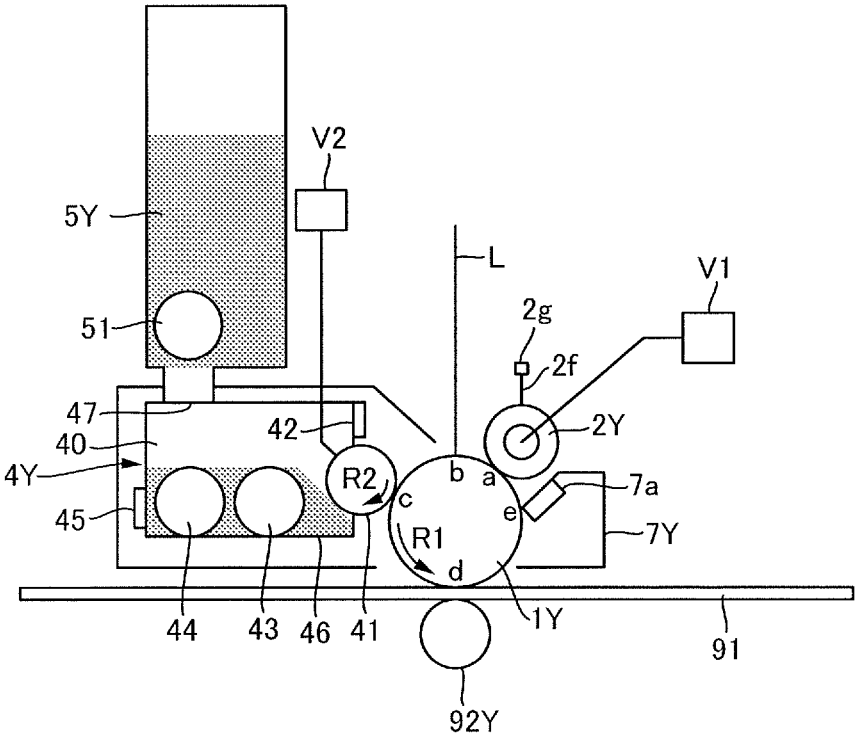
FIG. 2 is a schematic configuration sectional view which enlarges and illustrates an image forming portion of FIG. 1.

The toner image formed on the photosensitive drum 1Y is transferred (primary transfer) onto the intermediate transfer belt 91 which is an endless belt-like intermediate transfer body, in a primary transfer portion (d) as shown in FIG. 2. On an inner peripheral surface side of the intermediate transfer belt 91, a primary transfer roller 92Y which is a primary transfer member is provided to oppose the photosensitive drum 1Y. The toner image is transferred (primary transfer) to the intermediate transfer belt 91 from the photosensitive drum 1Y by the operation of the primary transfer roller 92Y. Similarly, the toner images of the respective colors on the photosensitive drums 1M, 1C, and 1Bk are transferred being consecutively superposed on the intermediate transfer belt 91, and color toner images are formed on the intermediate transfer belt 91. In addition, the color toner images formed on the intermediate transfer belt 91 are transferred (secondary transfer) at the same time onto the recording medium (for example, a sheet, such as a paper sheet) S which is conveyed to a secondary transfer portion N in which the intermediate transfer belt 91 and a secondary transfer roller 10, which is a secondary transfer member, oppose each other. Next, the recording medium S to which the toner image is transferred is conveyed to a fixing unit 13, and is discharged to the outside of the apparatus after the toner image is fixed here. The fixing unit 13 employs heat and pressure to the recording medium S by a pair of fixing rollers, and melts and fixes the toner image to the recording medium S.

Next, each element of the image forming portion PY will be described in more detail with reference to FIG. 2.

In the embodiment, the photosensitive drum 1Y is an organic photoconductor (OPC) drum, and an outer diameter thereof is 30 mm. In addition, the photosensitive drum 1Y is driven to be rotated in the arrow R1 direction (counterclockwise direction) in the drawing at the predetermined process speed (peripheral speed) of 240 mm/sec around a center supporting shaft.

The charging roller 2Y is a contact charge member which is formed in a shape of a roller. By applying a predetermined charge voltage to the charging roller 2Y, the photosensitive drum 1Y is uniformly charged to a charge potential of negative polarity. In the embodiment, the length of the charging roller 2Y in the longitudinal direction (rotation axial line direction) is 320 mm, and a surface layer on a base layer is coated around the outside of a core metal (support member). When being further described, in the charging roller 2Y, a stainless round rod having a diameter of 6 mm is used as the core metal, a layer which is made by dispersing carbon to a fluororesin is used as the surface layer, the outer diameter as a roller is 14 mm, and an electric resistance of a roller is $10^4\Omega$ to $10^7\Omega$. Each of both end portions of the core metal of the charging roller 2Y is rotatably held by a bearing member, and the charging roller 2Y is biased in the direction of the photosensitive drum 1Y by a pressing spring, and is in pressure-contact with the surface of the photosensitive drum 1Y by a predetermined pressing force. In addition, the charging roller 2Y rotates being driven by the rotation of the photosensitive drum 1Y.

In addition, a predetermined oscillation voltage (Vdc+Vac) which is made by superposing an AC voltage (Vac) having a predetermined frequency onto a DC voltage (Vdc), is applied to the charging roller 2Y via the core metal, from a charge power source (high voltage power source) V1 which serves as a charge voltage applying apparatus. Accordingly, a peripheral surface of the rotating photosensitive drum 1Y is charged to a predetermined potential (charge potential). A contact portion of the charging roller 2Y and the photosensitive drum 1Y is a charge position (a). In the embodiment, when an image is formed, the voltage (charge bias) applied to the charging roller 2Y is an oscillation voltage which is made by superposing a DC voltage of −500 V, and a sine wave AC voltage in which a frequency is 1,500 Hz and a peak-to-peak voltage is 1,700 V. By the charge voltage, the peripheral surface of the photosensitive drum 1Y is uniformly contact-charged to −500 V (charge voltage, dark potential Vd).

In addition, a charging roller cleaning member 2*f* is provided with respect to the charging roller 2Y. In the embodiment, the charging roller cleaning member 2*f* is a cleaning film having flexibility. The charging roller cleaning member 2*f* is disposed parallel to the longitudinal direction (rotation axial line direction) of the charging roller 2Y. In addition, one end of the charging roller cleaning member 2*f* is fixed to a support member 2*g* which reciprocates by a constant amount with respect to the longitudinal direction, and the charging roller cleaning member 2*f* is disposed to come into contact with the charging roller 2Y on a surface in the vicinity of a free end side. The support member 2*g* is driven via a gear train by a driving motor of the image forming apparatus 100, and reciprocates by a constant amount in the longitudinal direction, and accordingly, the surface layer of the charging roller 2Y is rubbed by the charging roller cleaning member 2*f*. According to this, adhered substances (fine powder toner, external additive, or the like) on the surface of the charging roller 2Y are removed.

The photosensitive drum 1Y receives an image exposed light (laser light L) by the exposing unit 3Y after being uniformly charged to predetermined polarity and potential by the charging roller 2Y. In the embodiment, the exposing unit 3Y includes a color separation and imaging exposure optical system of a color document image, or a scanning exposure system by a laser scanner which outputs a laser beam modulated corresponding to a time series electric digital pixel signal of image information. The electrostatic latent images of color components which correspond to each of the image forming portions PY, PM, PC, and PBk of a target color image are formed on each of the photosensitive drums 1Y, 1M, 1C, and 1Bk by each of the exposing units 3Y, 3M, 3C, and 3Bk.

In addition, in the embodiment, a laser beam scanner which uses a semiconductor laser is employed as the exposing unit 3Y. The laser beam scanner outputs the laser light modulated corresponding to the image signal sent to the image forming apparatus 100 side from the external host apparatus, and performs laser scanning exposure (image exposure) with respect to the uniformly charged surface of the rotating photosensitive drum 1Y. By lowering the potential at a portion which is irradiated with the laser light L on the photosensitive drum 1Y by the laser scanning exposure, the electrostatic latent image which corresponds to the image information is formed on the rotating photosensitive drum 1Y. In the embodiment, an exposed zone potential V1 is −150 V. An irradiation position of the image exposed light (laser light L) in a photosensitive drum 1Y is an exposure position (b).

The electrostatic latent image formed on the photosensitive drum 1Y is developed by the toner in the developing unit 4Y. In the embodiment, the developing unit 4Y is a two-component contact developing unit (two-component magnetic brush developing unit). The developing unit 4Y includes a development container 40, a developing sleeve 41 which serves as a developer bearing member that includes a magnet roller disposed to be fixed to the inside thereof, a developer regulation blade 42, and screws 43 and 44 which serve as developer stirring members arranged on a bottom portion side in the development container 40. In the development container 40, a two-component developer (developer) 46 which is mainly a mixture of resin toner particles (toner) and magnetic carrier particles (carrier) is accommodated.

A part of an outer peripheral surface of the developing sleeve 41 is exposed to the outside of the development container 40, and the developing sleeve 41 is rotatably arranged in the development container 40. In addition, the developing sleeve 41 bears the conveyed developer and rotates while performing the stirring by the screws 43 and 44. As the developer is stirred by the screws 43 and 44, respectively, the toner is charged to negative polarity and the carrier is charged to positive polarity.

The developer regulation blade 42, as a regulation member, opposes to the developing sleeve 41 with a predetermined gap, and a developer thin layer is formed on the developing sleeve 41 according to the rotation of the developing sleeve 41 in the arrow R2 direction (clockwise direction). In other words, the layer thickness of the developer borne to the developing sleeve 41 is regulated by the developer regulation blade 42. In the embodiment, the developing sleeve 41 holds the closest distance (S-Dgap) to the photosensitive drum 1Y to be 350 μm, and is oppositely arranged in the proximity to the photosensitive drum 1Y. A position where the photosensitive drum 1Y and the developing sleeve 41 oppose each other is a development position (c). In addition, the developing sleeve 41 is driven to be rotated so that the surface thereof at the development position (c) moves in the same direction as the advancing direction of the surface of the photosensitive drum 1Y.

The developer thin layer on the developing sleeve 41 comes into contact with the surface of the photosensitive drum 1Y at the development position (c), and appropriately rubs the photosensitive drum 1Y. A predetermined development voltage (development bias) having a DC component is applied to the developing sleeve 41 from a development power source (high voltage power source) V2 which serves as a development voltage applying apparatus. In the embodiment, the development voltage applied to the developing sleeve 41 is a voltage which is made by superposing the DC voltage (Vdc) and the AC voltage (Vac). More specifically, the development voltage is an oscillation voltage which is made by superposing a DC voltage of −350 V and an AC voltage in which the peak-to-peak voltage Vpp is 1,800 V and the frequency is 11 kHz.

Coating is performed on the rotating developing sleeve 41 as the thin layer, and the toner in the developer conveyed to the development position (c) is selectively adhered thereto corresponding to the electrostatic latent image formed on the photosensitive drum 1Y by the electric field by the development voltage. Accordingly, the electrostatic latent image on the photosensitive drum 1Y is developed as the toner image. In the embodiment, the toner is adhered to the exposed portion on the photosensitive drum 1Y and the electrostatic latent image is reverse-developed.

The developer thin layer on the developing sleeve 41, which passes the development position (c), returns to a developer reservoir portion in the development container 40 according to the continuous rotation of the developing sleeve 41. The screws 43 and 44 are provided in the developing unit 4Y. The screws 43 and 44 rotate in synchronization with the rotation of the developing sleeve 41, and have a function of stirring and mixing the replenished toner and carrier, and giving a predetermined electric charge to the toner. In addition, the screws 43 and 44 respectively convey the developer in the direction opposite to the longitudinal direction, and supply the developer to the developing sleeve 41. At the same time, the screws 43 and 44 have a function of conveying the developer which has a low toner concentration (ratio of the toner in the developer) by a developing process to a toner replenishing portion, and circulating the developer in the development container 40.

On a surface on the upstream side wall of screw 44 of the developing unit 4Y, a concentration sensor 45, which detects the toner concentration in the developer by detecting changes in magnetic permeability in the developer, is provided. On a slightly downstream side of the concentration sensor 45 in the circulating direction of the developer, a toner replenishing opening 47 is provided. After performing a developing operation, the developer is conveyed to a detection portion of the concentration sensor 45, and here, the toner concentration is detected. In accordance with the detection result, the toner replenishment is appropriately performed through the toner replenishing opening 47 of the developing unit 4Y from a toner replenishing unit 5Y by the rotation of a replenishing screw 51 provided with the toner replenishing unit (replenishing unit) 5Y which is connected to the developing unit 4Y. Thereby, the toner concentration in the developer is maintained to be constant.

The replenished toner is conveyed by the screw 44, and is mixed with the carrier, and an appropriate electric charge is applied. After this, the replenished toner is conveyed to the vicinity of the developing sleeve 41, is formed as the thin layer on the developing sleeve 41, and is used in development. In the embodiment, a negatively charged toner having an average particle diameter of 5.5 μm is used as the toner, and a magnetic carrier having saturation magnetization of 205 emu/cm$^3$ and an average particle diameter of 35 μm is used as the carrier. In addition, in the embodiment, a developer which is made by mixing the toner and the carrier at the weight ratio of 10:90 is used.

The toner (transfer residual toner) which is not transferred to the intermediate transfer belt 91 by the primary transfer portion (d) and remains on the photosensitive drum 1Y is removed from the photosensitive drum 1Y by a cleaning unit 7Y as a photoconductor cleaning member. The cleaning unit 7Y removes the transfer residual toner on the photosensitive drum 1Y by using a cleaning blade 7*a* which serves as a cleaning member provided to abut against the photosensitive drum 1Y. The photosensitive drum 1Y of which the surface is cleaned is used in the next image forming process. As a material of the cleaning blade 7*a*, a urethane rubber-based material is widely used.

It is noted that, in the embodiment, by using the exposing unit 3Y and the developing unit 4Y, a toner imaging forming portion which forms the toner image on the photosensitive drum 1Y charged by the charging roller 2Y is configured. In addition, the photosensitive drum 1Y, the charging roller 2Y, the developing unit 4Y, and the cleaning unit 7Y are integrally configured as a cartridge, and configure the process cartridge 8Y which is attachable to and detachable from the apparatus body.

Figure 3:
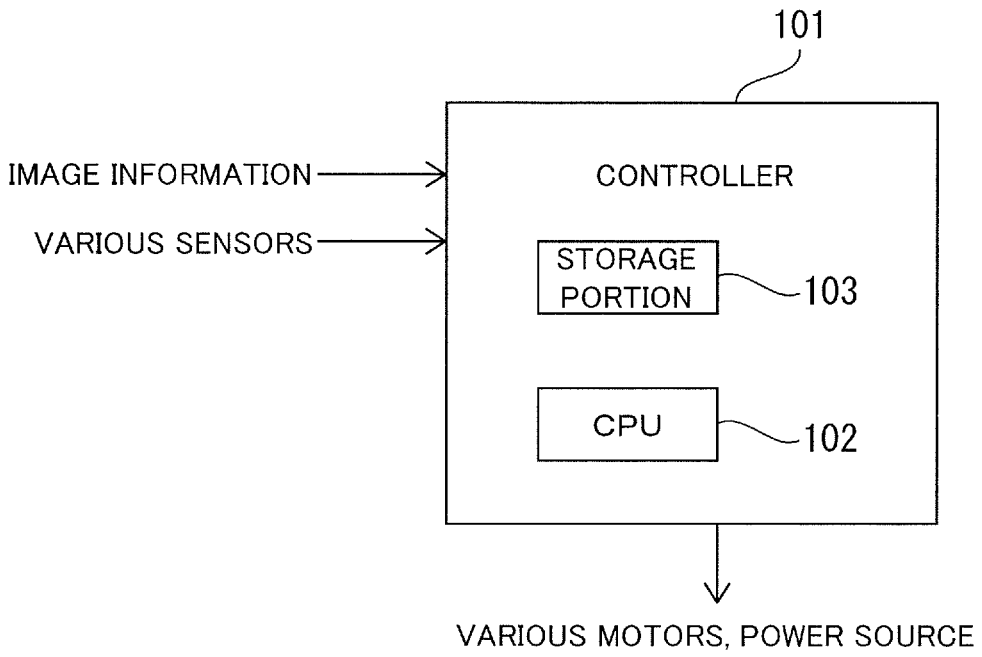
FIG. 3 is a control block diagram of the image forming apparatus according to the first embodiment.

As illustrated in FIG. 3, the image forming apparatus 100 configured in this manner includes a controller 101 which controls an image forming operation. The controller 101 includes a CPU 102 and a storage portion 103, and controls various motors or power sources based on the image information and the input of various sensors. In other words, the controller 101 generally controls the operation of the image forming apparatus 100 including instruction of an operation of driving and stopping a driving device of the photosensitive drums 1Y, 1M, 1C, and 1Bk or the intermediate transfer belt 91, instruction of starting and stopping of application of voltage of the charge power source V1 or the development power source V2, and setting of a voltage application condition.

Pre-Rotation Process

Figure 4:
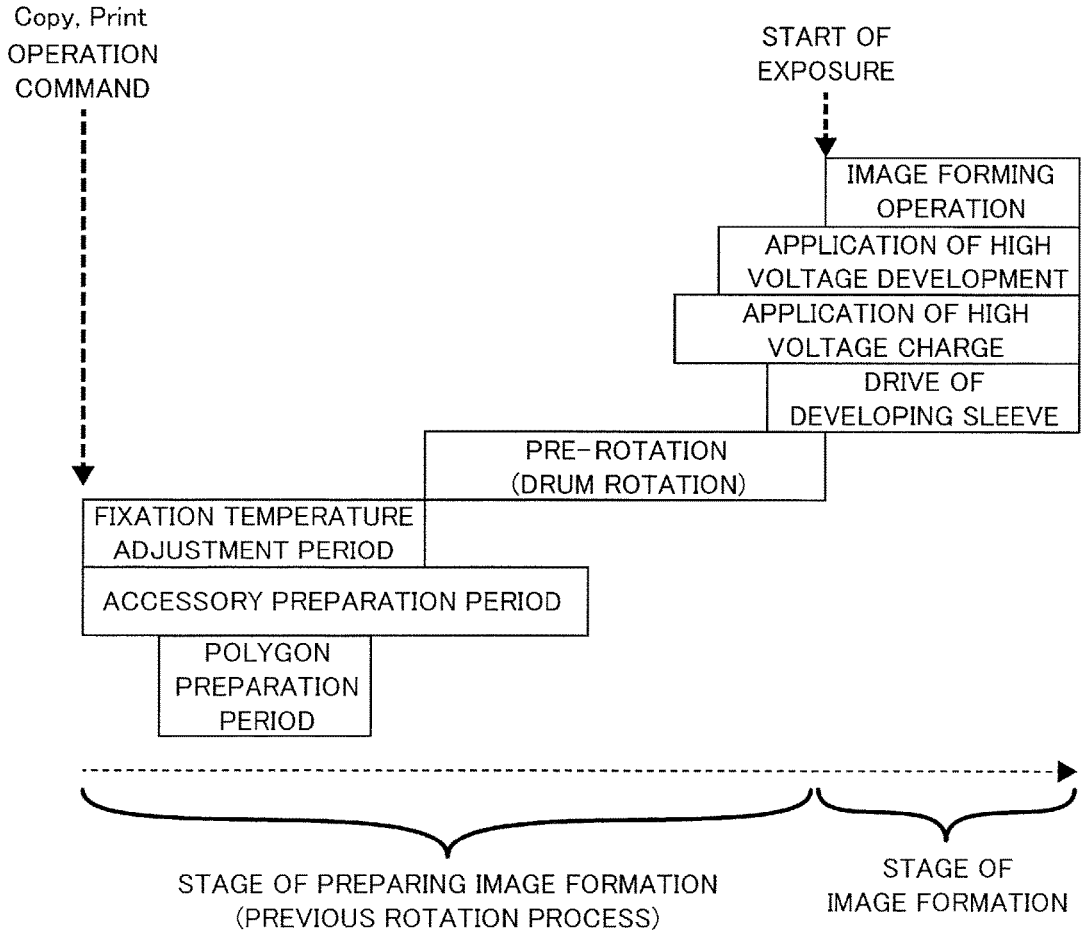
FIG. 4 is a schematic view illustrating an operation timing of each portion from a pre-rotation process to the start of the image formation in the first embodiment.

Next, a so-called pre-rotation process (pre-rotation operation) which is a predetermined operation period of stage of preparing an image formation before the start of the image formation in the embodiment will be described by using FIG. 4. As illustrated in FIG. 4, in a case where a timing of the start of the image formation is defined as a stage where the photosensitive drum 1Y is irradiated with the laser from the exposing unit 3Y and the exposure is started, in general, the stage of preparing the image formation is performed before the start of the image formation. This is generally called the pre-rotation process. The pre-rotation process is performed for stably driving the photosensitive drum 1Y or stabilizing the charge potential (drum potential) of the surface of the photosensitive drum 1Y by applying the electric charge (high charge voltage). Therefore, in the pre-rotation process, the photosensitive drum 1Y is driven to be rotated in advance, or the application of each voltage (high voltage) is started before the start of the image formation.

In the pre-rotation process, first, the controller 101 outputs a command (command of image forming operation) of a COPY operation or a PRINT operation. In addition, a heating operation of the fixing unit 13 is started, and the heating is continued until the fixing roller reaches a predetermined fixing temperature, and when the fixing roller reaches the fixing temperature, a so-called temperature control for maintaining the temperature is performed (fixing temperature adjustment period). In addition, at a timing which is substantially the same as the timing, preparation of accessory types (not illustrated) which are provided in the apparatus body is performed (accessory preparation period). For example, in the case where a tray to which the recording medium to which the toner image is fixed by the fixing unit 13 is discharged is provided, the preparation of accessory indicates a movement of the tray of a finisher which performs processing, such as stapling, with respect to the discharged recording medium, for example. Furthermore, activation of a polygon mirror of the exposing unit 3Y in the body is started (polygon preparation period) in parallel with the heating operation of the fixing unit 13 or the preparation of accessory. In general, since it does not take much time to stabilize the speed from the start of activating the polygon mirror, in many cases, the polygon preparation period is finished in the middle of the period of heating the fixing unit 13 or the preparation period of accessory.

Next, after the temperature of the fixing roller reaches the necessary temperature, the rotation of the photosensitive drum 1Y is started (pre-rotation). There is a case where the rotation (drum rotation) of the photosensitive drum 1Y overlaps the preparation period of accessory, but this does not cause a particular problem. In addition, the drum rotation and the fixing temperature adjustment period may overlap each other, but it is preferable that the rotation of the photosensitive drum 1Y is started after reaching the fixing temperature since it is possible to shorten the drum rotation time in the pre-rotation process, and to suppress deterioration of service life.

Next, the application of high voltage is started in an order of the high charge voltage which is applied to the charging roller 2Y and the development voltage which is applied to the developing unit 4Y (application of high charge voltage, application of high development voltage). Since the charging roller 2Y is further on the upstream side in the direction of rotation of the photosensitive drum 1Y than the development position, the high voltage is applied in this order in order to hold the relationship between the drum potential of the photosensitive drum 1Y and the development potential, that is, the so-called Vback, to be constant at the development position.

Next, the developing sleeve 41 is started to be rotated (drive of developing sleeve). Therefore, in the pre-rotation process, in response to the start of the image formation, the rotation of the developing sleeve 41 is started after the charging by a charging roller 2Y is started and the application of the development voltage is started. The developing sleeve 41 may be rotated immediately before the start of the image forming operation, that is, the start of the exposure, but it is preferable that a timing which the developing sleeve 41 is started is set by considering time from the start of activating the developing sleeve 41 until reaching a stable range of the speed of the developing sleeve 41. The operation up to here, that is, the operation from the command of the image forming operation to the start of the exposure (start of forming an electrostatic latent image) is called the stage of preparing the image formation (pre-rotation process).

Toner Adhesion to Developing Sleeve

Next, a mechanism of toner adhesion to the developing sleeve will be described. The toner adhesion to the developing sleeve occurs by a potential difference between the developing sleeve and the photosensitive drum at the time of falling the voltage (stop of voltage application) in response to the completion of the image formation, but the occurrence situation thereof is largely caused by a state of the developer at the time, in particular, a toner charging amount. As described above, the developer of a two-component developing system is configured of the toner and the carrier, and the toner and the carrier can obtain the charging amount by frictional charging. Here, in a case where the charging amount of the toner is increased due to the condition, such as a use situation of the developer, the toner is less likely to be developed to the photosensitive drum, and it is not possible to obtain a desired image concentration. Therefore, the control for suppressing the charging amount of the toner is performed. Due to this, in the embodiment, by increasing the toner concentration, the contact ratio of the toner with respect to the carrier is lowered, and the charging amount of the toner is suppressed.

Specifically, as described above, the toner concentration in the developer is detected by using the concentration sensor 45. In addition, the rotation of the replenishing screw 51 is controlled so that the toner concentration becomes a target toner concentration (refer to FIG. 2). The target toner concentration is determined by investigating the toner mounting amount by forming a test pattern. In other words, a predetermined toner image (test pattern) is formed on the intermediate transfer belt 91 at a predetermined interval (for example, every predetermined number of image formations) by the command of the controller 101. In addition, by detecting the toner mounting amount of the test pattern, the charging amount of the toner is detected. In other words, as illustrated in FIG. 1, a toner mounting amount detection sensor which serves as a sensor that detects the toner mounting amount is disposed downstream of image forming portion PBk in the moving direction of the intermediate transfer belt 91. The toner mounting amount detection sensor 97 is an optical reflection type sensor. In addition, the controller 101 calculates the toner mounting amount on the intermediate transfer belt 91 from a difference between a reflected light amount of the intermediate transfer belt 91 in an area where the toner is not mounted thereon, and that in an area where the toner is mounted thereon, which are detected by the toner mounting amount detection sensor 97.

In addition, the controller 101 acquires the charging amount of the toner in the developing unit (in the development container 40) from the toner mounting amount, for example, by a relationship (relational expression or table) between the toner mounting amount and the charging amount of the toner which are stored in the storage portion 103. Here, the charging amount of the toner is low in a case (a case where the toner mounting amount is large) where a large amount of toner is mounted on the intermediate transfer belt 91, and on the contrary, the charging amount of the toner is high in a case (a case where the toner mounting amount is small) where the toner amount mounted on the intermediate transfer belt 91 is small.

Therefore, when a large amount of toner is mounted on the intermediate transfer belt 91, it is determined that the charging amount of the toner is low, and the toner concentration in the developer is controlled to be low. On the contrary, when the toner amount mounted on the intermediate transfer belt 91 is small, it is determined that the charging amount of the toner is high, and the toner concentration in the developer is controlled to be high. The adjustment of decreasing or increasing the toner concentration is performed by increasing or decreasing a replenishing amount of the toner to the development container 40. In other words, the rotation of the replenishing screw 51 is controlled so that the toner concentration become the target toner concentration (refer to FIG. 2). In this manner, the concentration sensor 45 which is illustrated in FIG. 2 and detects the toner concentration may be omitted, and it is possible to stabilize the charging amount of the toner by increasing and decreasing the replenishing amount of the toner in accordance with the toner mounting amount which is detected by the toner mounting amount detection sensor 97.

It is noted that the target toner concentration may be determined by various methods known in the related art, such as a determining method by the environment in the apparatus, a determining method by use time of the apparatus, or appropriate combinations of the methods.

However, since the contact ratio of the toner with respect to the carrier becomes extremely low when the toner concentration in the developer becomes extremely high, irregularity can occur in the charging amount of the toner in the developer, and a toner having a high charging amount and a toner having a low charging amount are generated. Among these, the toner having a low charging amount has a small electrostatic force which makes the toner and the carrier attract each other, and thus, the toner is separated from a surface of the carrier, and is likely to move by the electric field between the developing sleeve and the photosensitive drum. In addition, when the electric field which attracts the toner to the developing sleeve side, that is, Vback, is applied, a phenomenon (sleeve adhesion) in which the toner having a low charging amount is adhered to the surface of the developing sleeve is likely to occur. In other words, among the toners which are borne to the surface of the developing sleeve, and are adhered to the surface of the carrier that comes into contact with the photosensitive drum, in particular, the toner having a low charging amount is adhered to the surface of the developing sleeve by Vback.

For example, in a case where a surface potential (charging potential) of the photosensitive drum 1Y is −500 V, and the development voltage of −350 V is applied to the developing sleeve 41, in particular, the toner having a low charging amount is attracted the surface of the developing sleeve 41 by Vback of 150 V. Then, the toner adhesion to the developing sleeve 41 occurs. In particular, in the pre-rotation process according to the start of the image formation or in a post-rotation process in response to the completion of the image formation, if Vback is applied when the rotation of the developing sleeve 41 is stopped, the toner adhesion particularly remarkably occurs at a portion of the surface of the developing sleeve 41 which opposes the photosensitive drum 1Y. Specifically, in the pre-rotation process, in response to the start of the image formation, the rotation of the developing sleeve 41 is started after the start of the charging by the charging roller 2Y and the start of the application of the development voltage. Meanwhile, in the post-rotation process, in response to the completion of the image formation, the charging by the charging roller 2Y is stopped and the application of the development voltage is stopped after the rotation of the developing sleeve 41 is stopped. Therefore, even in any process, Vback is applied in a state where the rotation of the developing sleeve 41 is stopped, and the toner adhesion is likely to occur at a part of the surface of the developing sleeve 41.

After this, in the following operation in the pre-rotation process, in the next image forming operation in the post-rotation process, a phenomenon in which the image concentration becomes high only in an area where the toner adhesion occurs on the surface of the developing sleeve 41 occurs, because the area is different from other areas in the electric field between the developing sleeve 41 and the photosensitive drum 1Y by the charge of the adhered toner. For example, in a case where an exposed zone potential V1 of the photosensitive drum 1Y is −150 V and −350V is applied to the developing sleeve 41, the negatively charged toner is developed by 200 V of potential difference. However, the area where the toner adhesion occurs on the surface of the developing sleeve 41 becomes in a state where the potential difference is slightly higher than 200 V by the charge of the toner, and the concentration only in the area becomes high.

As described above, the toner adhesion is likely to occur in a state where the charging amount of the toner is high and the toner concentration is high. Therefore, in a situation where the toner charging amount becomes high, that is, in an initial state of the developer where the charging performance of the carrier is high, under a low humidity condition, the toner adhesion (the sleeve adhesion) to the developing sleeve is likely to occur. On the contrary, in a state where the charging amount of the toner is low and the toner concentration is controlled to be low, since the contact ratio of the toner with respect to the carrier is high and a weakly charged toner is unlikely to be generated, the toner adhesion to the developing sleeve is unlikely to occur.

In particular, the sleeve adhesion of the toner can also occur even in the initial state (for example, a case where image formation is performed 100,000 or more and less than 200,000 sheets) of the developer where the use of the developer in the developing unit is started. In other words, when the developer has not been used that much and the charging performance of the carrier is high, the toner concentration is controlled to be high. Meanwhile, when the developer has been used for a long period of time and the charging performance of the carrier deteriorates, the toner concentration is controlled to be low. Therefore, in a case where the toner concentration is controlled to be high in the initial state where the developer has not been used that much, the sleeve adhesion of the toner is likely to occur, and in a case where the developer has been used for a long period of time and the toner concentration is controlled to be low, the toner adhesion to the developing sleeve is unlikely to occur.

Here, if the developing sleeve is sufficiently rotated in the pre-rotation which is the image forming preparation operation performed before the start of the image formation, the toner on the developing sleeve is made uniform by the regulation blade which regulates the layer thickness of the toner layer on the developing sleeve. Therefore, it is possible to suppress the toner adhesion on the developing sleeve to a level at which the abnormal image is not generated. However, when performing an operation of sufficiently rotating the developing sleeve every time the pre-rotation is performed, deterioration of the developer in the developing unit is accelerated, a phenomenon of fogging or scattering is likely to occur, and the service life of the developing unit lowers by shaving or the like of the developing sleeve.

Rising Control

Here, in the embodiment, the total number of rotations of the developing sleeve 41 in the pre-rotation process (during a predetermined operation period) is changed in accordance with the use state of the developer. In other words, a pre-rotation mode 1 which is a first mode and a pre-rotation mode 2 which is a second mode, which will be described later, are switched. A deterioration situation of the carrier due to the use can be ascertained from a rotation amount (here, rotation time) of the developing sleeve 41. In other words, in a case where the rotation amount (rotation time) of the developing sleeve 41 is smaller than a predetermined rotation amount (predetermined rotation time), since the carrier does not deteriorate and the charging amount of the toner is high, the toner concentration is likely controlled to be high. Therefore, in this case, it is determined that the toner adhesion to the developing sleeve 41 is likely to occur. Meanwhile, in the case where the rotation amount (rotation time) of the developing sleeve 41 is equal to or larger than the predetermined rotation amount (equal to or larger than the predetermined rotation time), since the carrier deteriorates and the charging amount of the toner is low, the toner concentration is likely controlled to be low. Therefore, in this case, it is determined that the toner adhesion to the developing sleeve 41 is unlikely to occur.

Therefore, in the embodiment, the storage portion 103 illustrated in FIG. 3 stores an integrated rotation amount (the rotation time) of the developing sleeve 41. The rotation amount (the rotation time) is integrated by the controller 101. In addition, the controller 101 switches the pre-rotation mode 1 and the pre-rotation mode 2 in accordance with the rotation time stored in the storage portion 103. In other words, the controller 101 can perform the pre-rotation mode 1 and the pre-rotation mode 2. In addition, the pre-rotation mode 1 is performed in the case where the rotation time of the developing sleeve 41 is shorter than the predetermined rotation time, and the pre-rotation mode 2 is performed in the case where the rotation time of the developing sleeve 41 is equal to or larger than the predetermined rotation time.

Figure 5:
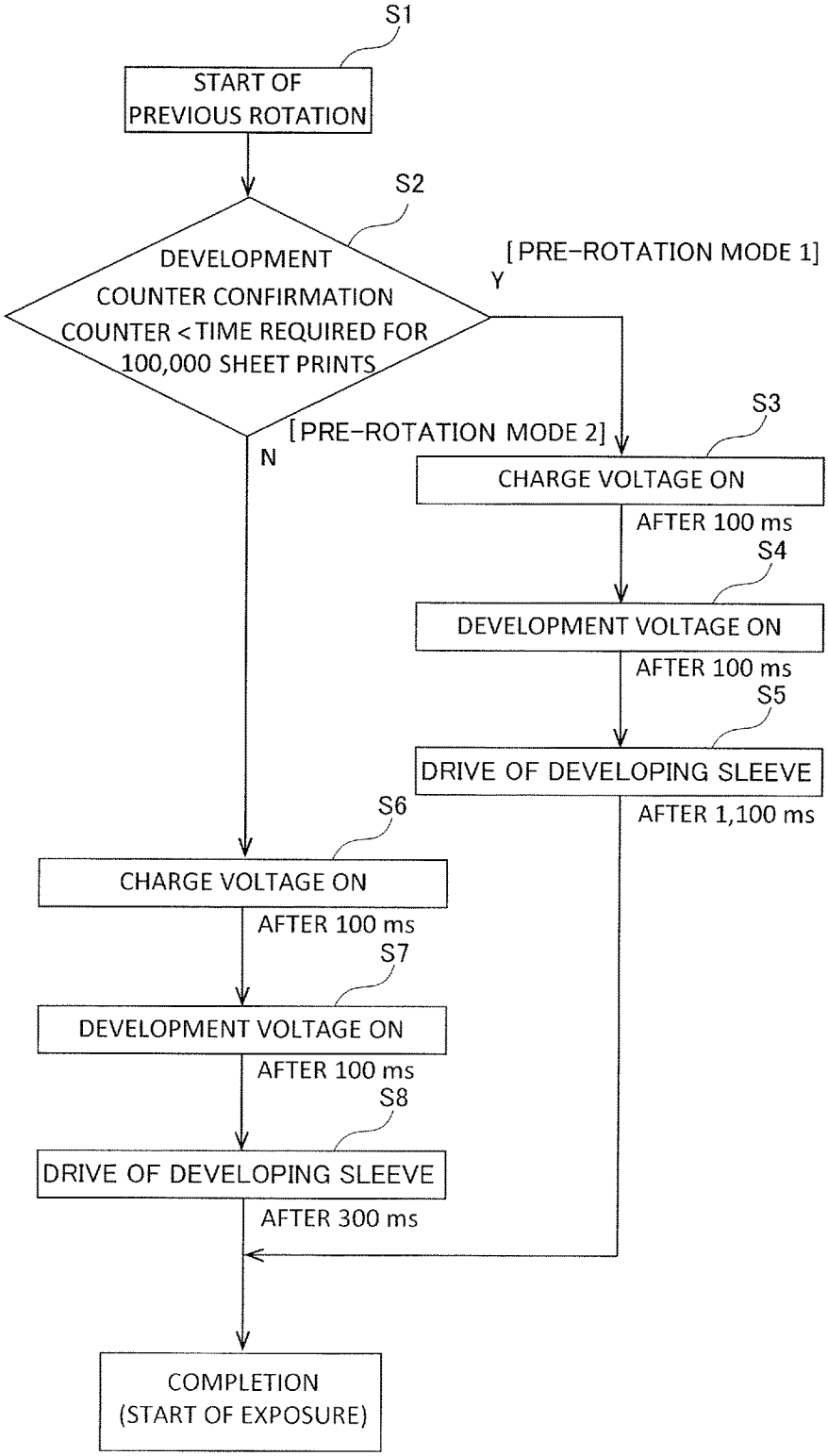
FIG. 5 is a flow chart of rising control of the pre-rotation process according to the first embodiment.

Hereinafter, rising control in the pre-rotation process of the embodiment will be specifically described. As illustrated in FIG. 5, when the operation of the pre-rotation which is the predetermined operation period before the start of the image formation is started (S1), the controller 101 obtains information (counter) of the rotation time of the developing sleeve 41 from the storage portion 103 (development counter confirmation). In addition, it is determined whether or not the counter is smaller than the predetermined rotation time stored in the storage portion 103, and the mode of the pre-rotation is determined (S2). In the embodiment, for example, the predetermined rotation time is set to be a time equivalent to a time required for 100,000 sheet prints on a sheet having a lateral size of A4. Next, in a case (Y in S2) where the counter is smaller than the predetermined rotation time (smaller than the time required for 100,000 sheet prints), it is determined that the sleeve adhesion of the toner is likely to occur, and the process advances to S3 (pre-rotation mode 1). On the contrary, in the case (N in S2) where the counter is equal to or larger than the predetermined rotation time (equal to or greater than the time required for 100,000 sheet prints), it is determined that the sleeve adhesion of the toner is unlikely to occur, and the process advances to S6 (pre-rotation mode 2). It is noted that, since the value as a developer deterioration standard, which is the time value corresponding to 100,000 sheet prints in this embodiment, is a value which is determined by the kinds of the used developer, the value itself changes in accordance with a performing machine.

Next, a timing setting method of a start of rotating the developing sleeve 41 in the rising control in the pre-rotation process after S3 and S6 will be described. In accordance with the deterioration state of the developer identified in the above-described S2, after S3 and S6, the timing of the start of driving the developing sleeve 41 during the pre-rotation is changed. In other words, in the pre-rotation mode 1, the timing of the start of rotating the developing sleeve 41 in the pre-rotation process (in the predetermined operation period) is earlier than that in the pre-rotation mode 2.

Pre-Rotation Mode 1

Figure 6:
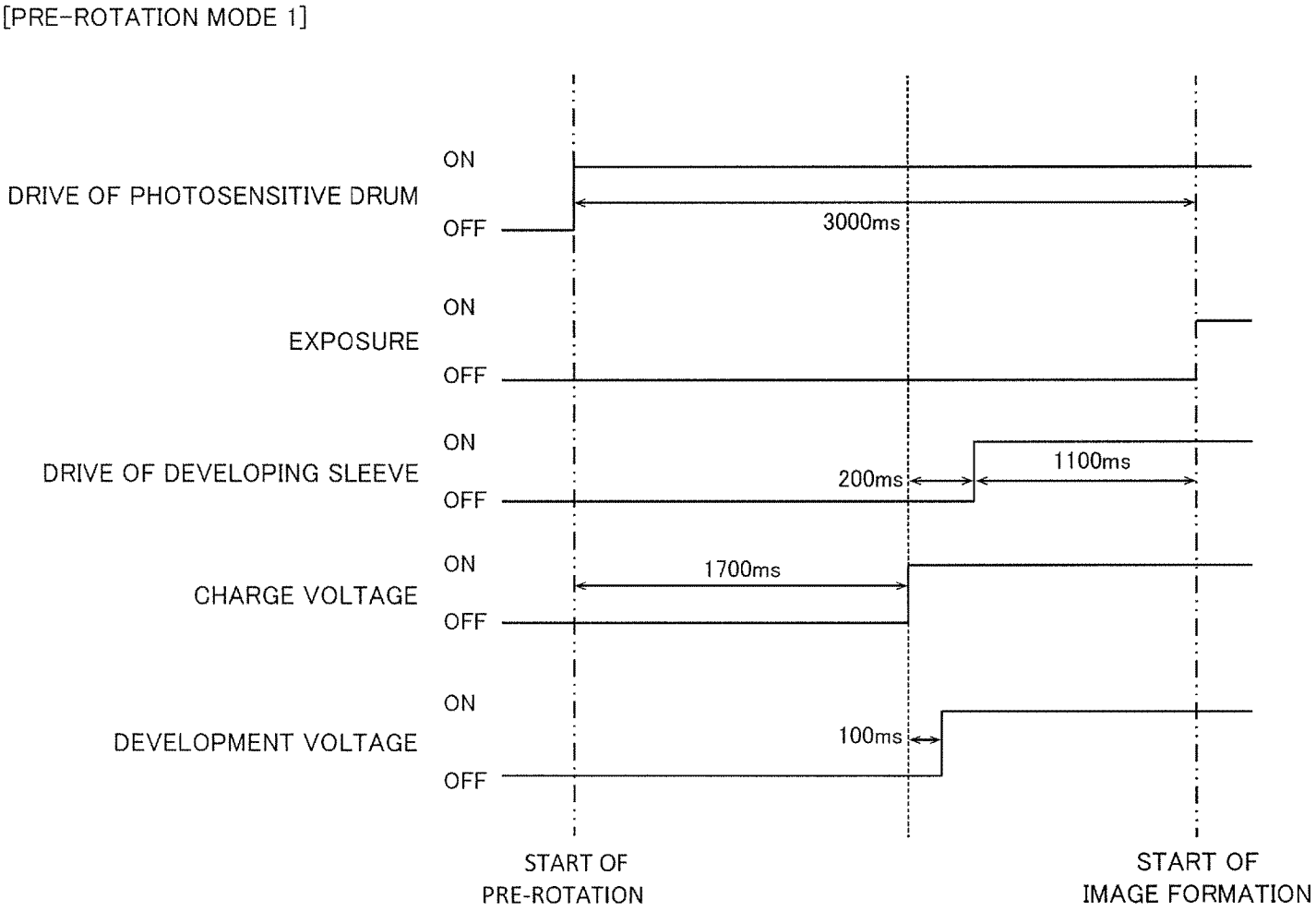
FIG. 6 is a timing chart of rising control of a pre-rotation mode 1 according to the first embodiment.
Figure 7:
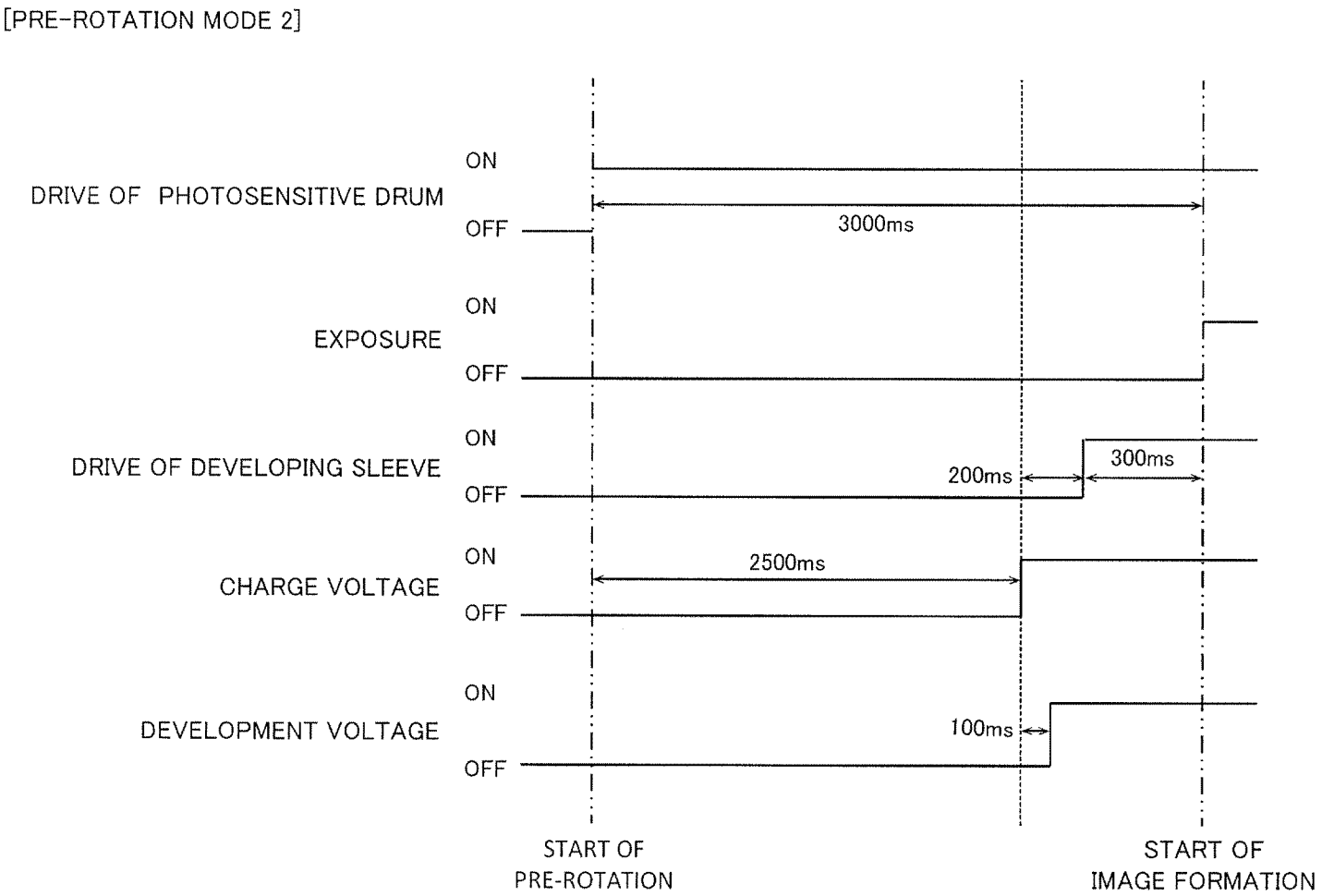
FIG. 7 is a timing chart of rising control of a pre-rotation mode 2 according to the first embodiment.

First, the pre-rotation mode 1 (after S3) which is the first mode will be described with reference to FIG. 6. It is noted that FIG. 6 and FIG. 7 which will be described later are timing charts of the start of the rotational drive of the photosensitive drum 1Y (drive of photosensitive drum ON), the start of exposure by the exposing unit 3Y (exposure ON), the start of the rotational drive of the developing sleeve 41 (drive of developing sleeve ON), the start of application of the charge voltage by the charging roller 2Y (charge voltage ON), and the start of application of the development voltage by the developing unit 4Y (development voltage ON). In other words, FIGS. 6 and 7 are timing charts of the rising of each portion.

Figure 8:
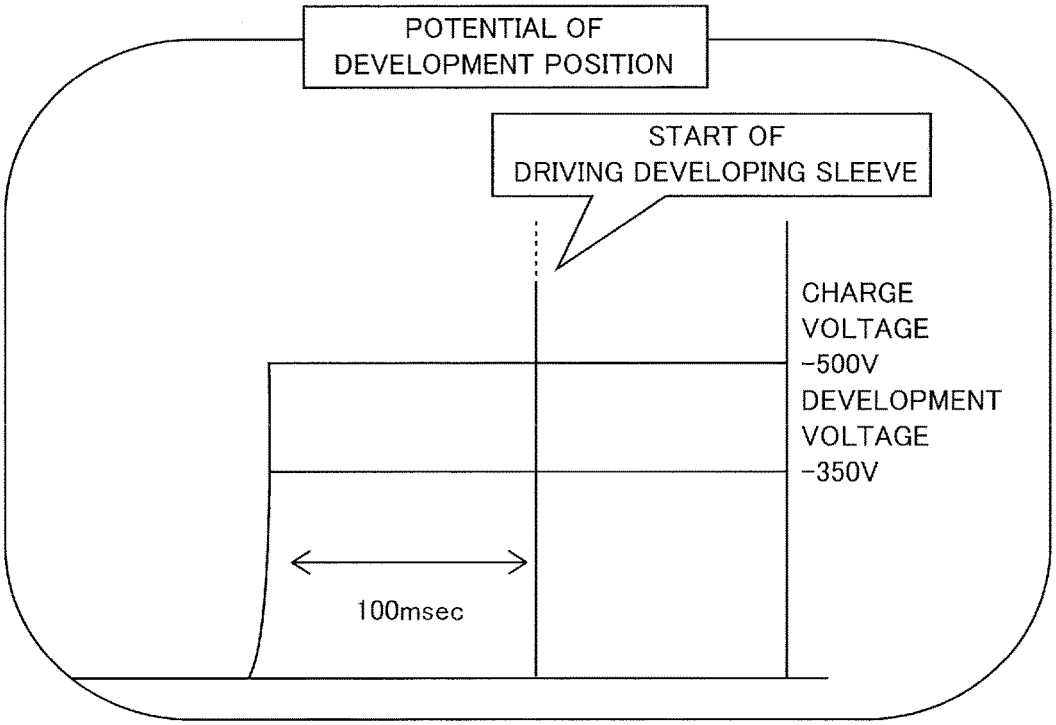
FIG. 8 is a schematic view illustrating a relationship between a charge voltage and a development voltage at a development position in the rising control of the first embodiment.

In the pre-rotation mode 1, the application of the charge voltage is started after 1,700 msec from the start of the pre-rotation operation (start of driving the photosensitive drum 1Y) (S3). In addition, the application of the development voltage is started after 100 msec (S4), and further, the drive of the developing sleeve 41 is started after 100 msec after applying the development voltage (S5). In other words, time from the start of rotating the photosensitive drum 1Y to the start of rotating the developing sleeve 41 is 1,900 msec (1,700+100+100, first time). In addition, the rotational speed of the developing sleeve 41 at this time is set to be the predetermined rotational speed. Here, since the distance from the charge position (a) to the development position (c) illustrated in FIG. 2 is 24 mm, and the rotational speed of the photosensitive drum 1Y is 240 ram/sec, a time lag from the charge position (a) to the development position (c) corresponds to 100 msec. As illustrated in FIG. 8, when viewed at the timing at the development position, at substantially the same time as the time when the charge potential becomes ON and the charged surface of the photosensitive drum 1Y reaches the development position, the development potential becomes ON. In addition, the development potential and the drum potential hold a constant relationship.

When the difference between the development potential and the drum potential is extremely large, the carrier adheres to the photosensitive drum, and when the difference is extremely small, the toner is adhered (covers) the surface of the photosensitive drum, and the toner is consumed. Therefore, it is important to hold the relationship of the potentials. In other words, as described in the embodiment, by setting the development potential to be ON after 100 msec after setting the charge potential to be ON, the electric field is applied to transfer the toner borne on the developing sleeve 41 to the surface of the developing sleeve 41, and thus, it is possible to suppress the toner from being consumed.

In addition, the timing of the start of driving the developing sleeve 41 is generally later than the timing of the development potential ON. As described above, the relationship between the drum potential and the development potential at the development position is extremely important, but when the high voltage falls and when the high voltage rises, it is difficult to accurately control the relationship. Therefore, the relationship between the drum potential and the development potential, that is, the so-called Vback, is designed on the assumption of having a certain level of oscillation. Therefore, even when a certain level of oscillation of Vback is present, in order to avoid the transfer of the carrier or the toner on the developing sleeve 41 onto the photosensitive drum as much as possible, the drive of the developing sleeve 41 is stopped until the development potential is given and stabilized. In the embodiment, the rotation of the developing sleeve 41 is started after 100 msec from the timing at which the development potential is given. If 100 msec elapsed from the development potential ON, the drum potential and the development potential are sufficiently stable, and thus, the relationship of Vback is stably maintained.

However, in a state where Vback is stabilized, since the electric field which transfers to the surface of the developing sleeve 41 is applied to the toner borne on the developing sleeve 41, the toner adhesion to the developing sleeve 41 is likely to occur while the drive of the developing sleeve 41 is stopped. In particular, in a situation where the integrated driving time (rotation time) of the developing sleeve 41 is smaller than the time required for 100,000 sheet prints, and deterioration of the developer has not been progressed that much, the toner adhesion to the developing sleeve 41 is likely to occur as described above. Therefore, in a case where the integrated driving time of the developing sleeve 41 is smaller than the time required for 100,000 sheet prints, the toner adhered to the developing sleeve 41 is made uniform.

In other words, in the pre-rotation mode 1, the timing of the start of driving the developing sleeve 41 is slightly earlier than the normal timing so that the exposure (forming of electrostatic latent image) is started by the exposing unit 3Y after 1,100 msec after the start of driving the developing sleeve 41. Accordingly, the total number of rotations of the developing sleeve 41 in the pre-rotation process is large. In the embodiment, the time from the start of driving the developing sleeve 41 to the start of the exposure is set to be 1,100 msec, but it is desirable that the time changes in accordance with the rotational speed of the developing sleeve 41 or the outer diameter of the developing sleeve 41. It is desirable that the developing sleeve 41 is designed to rotate 5 to 30 times until the start of the exposure.

Pre-Rotation Mode 2

Next, the pre-rotation mode 2 (after S6) which is the second mode will be described with reference to FIG. 7. In the pre-rotation mode 2, the application of the charge voltage is started after 2,500 msec from the start of the pre-rotation operation (start of driving the photosensitive drum 1Y) (S6). In addition, the application of the development voltage is started after 100 msec (S7), and further, the drive of the developing sleeve 41 is started after 100 msec after applying the development voltage (S8). In other words, time from the start of rotating the photosensitive drum 1Y to the start of rotating the developing sleeve 41 is 2,700 msec (2,500+100+100, second time). In addition, the rotational speed of the developing sleeve 41 at this time is set to be a predetermined rotational speed, similar to the pre-rotation mode 1. In this case, similar to the above-described pre-rotation mode 1, by setting the development potential to be ON after 100 msec after setting the charge potential to be ON, the electric field is applied to transfer the toner borne on the developing sleeve 41 to the surface of the developing sleeve 41, and the toner is suppressed from being consumed.

However, in the case where the rotational time of the developing sleeve 41 is equal to or larger than the developing sleeve rotational time which corresponds to the time required for 100,000 sheet prints, the developer deteriorates, and the toner adhesion to the developing sleeve 41 is unlikely to occur. Therefore, in the pre-rotation mode 2, the timing of the start of driving the developing sleeve 41 is later than that in the pre-rotation mode 1 so that the exposure is started after 300 msec from the start of driving the developing sleeve 41. From the viewpoint of deterioration of the developer in a developing unit 4Y, it is desirable that the time period during which the developing sleeve 41 rotates from the start of driving the developing sleeve 41 to the exposure is short. However, the time period from the time when the developing sleeve 41 is started to be driven to the time when the rotational speed is stabilized, and a delay of a software signal are added, and in the embodiment, the time period during which the developing sleeve 41 rotates from the start of driving the developing sleeve 41 to the exposure is set to be 300 msec. It is needless say that the rotational time of the developing sleeve 41 may not be 300 msec and can be further shortened in a case where a configuration in which the rotational speed rising of the developing sleeve 41 is excellent is employed. It is noted that, both in the pre-rotation mode 1 and the pre-rotation mode 2, the rotational speed of the developing sleeve 41 (predetermined rotational speed) is the same speed as that of the normal image formation (rotational speed when the electrostatic latent image is developed).

In the pre-rotation mode 2, by setting the timing of the start of driving the developing sleeve 41 to be extremely late, it is possible to suppress the integrated rotational time of the developing sleeve 41. In addition, it is possible to suppress deterioration of the developer in the developing unit 4Y or shaving of the developing sleeve 41. In other words, it is possible to maintain the service life of the developing unit 4Y for an extremely long period of time.

In the embodiment, the pre-rotation mode 1 in which the total number of rotations of the developing sleeve 41 in the pre-rotation process is large, and the pre-rotation mode 2 in which the total amount of rotations is small, are switched based on the information which influences the toner charging amount. Specifically, the pre-rotation mode 1 and the pre-rotation mode 2 are switched in accordance with the rotational time of the developing sleeve 41.

In other words, in a case where the rotational time of the developing sleeve 41 is shorter than the predetermined rotational time, it is determined that the developer has not deteriorated and the charging amount of the toner is also high. In addition, in the pre-rotation process, the timing of the start of rotating the developing sleeve 41 is set to be early and the total number of rotations of the developing sleeve 41 is set to be large. In other words, in a case where the toner is electrostatically firmly adhered to the developing sleeve 41, in order to make the toner adhesion uniform, it is important how many times the toner adhesion on the developing sleeve 41 passes through the gap between the developer regulation blade 42 and the developing sleeve 41. Since it is known that the toner adhesion is peeled off or made uniform by rubbing with the developer regulation blade 42 and rubbing with the developer in the developing unit 4Y, whether or not the toner adhesion is eliminated depends on the number of rotations of the developing sleeve. Therefore, under a condition that the sleeve adhesion of the toner is likely to occur, by performing the pre-rotation mode 1, the total number of rotations of the developing sleeve 41 in the pre-rotation process is large, and the adhered toner is made to be uniform. In addition, the toner adhesion on the developing sleeve 41 is suppressed until the level at which the abnormal image is not generated.

Meanwhile, the developer deteriorates in the case where the rotational time of the developing sleeve 41 is equal to or larger than the predetermined rotational time, and the charging amount of the toner also becomes low. Therefore, it is determined that the toner adhesion to the developing sleeve 41 is unlikely to occur. In addition, by performing the pre-rotation mode 2, as the timing of the start of rotating the developing sleeve 41 is the same as the time when normal image formation is performed, and the rotation is started immediately before the start of the image formation, the total number of rotations of the developing sleeve 41 is smaller than that in the pre-rotation mode 1. In this manner, in the pre-rotation mode 2, by making the total number of rotations of the developing sleeve 41 extremely small, the deterioration of the developer in the developing unit 4Y and the shaving of the developing sleeve 41 are suppressed.

In this configuration, only in a situation where the toner adhesion to the developing sleeve 41 is likely to occur, it is possible to suppress generation of the abnormal image by the toner adhered to the developing sleeve 41. In addition, since deterioration of the developer and the shaving of the developing sleeve 41 or the like may occur if the rotational time of the developing sleeve 41 becomes long every time, it is possible to suppress the service life of the developer from being shortened due to deterioration of the developer, and to suppress the developing performance from deteriorating due to the shaving of the developing sleeve 41 or the like. In other words, both the suppression of generation of the abnormal image due to the toner adhesion to the developing sleeve 41, and the suppression of deterioration of the developer or deterioration of the service life of the developing unit 4Y, are achieved.

It is noted that, since deterioration of the developer is suppressed, it is possible to exchange the developer in the developing unit with a fresh developer. However, to this end, the developer in the developing unit is discharged once before being used in the image formation, and instead of this, the fresh developer is replenished. As a result, the toner is consumed more than necessary, and the consumption amount of the toner increases to be equal to or larger than the amount of the image formation. Meanwhile, in the embodiment, without performing such an operation, since it is possible to suppress deterioration of the developer, it is possible to suppress unnecessary toner consumption. However, the operation may be performed as necessary.

In addition, in order to suppress generation of the abnormal image due to the sleeve adhesion of the toner, it is considered to extend the pre-rotational time every time and to increase the total number of rotations of the developing sleeve. However, in this case, productivity of a product itself deteriorates. Meanwhile, in the embodiment, by controlling the timing of the start of rotating the developing sleeve 41 without extending the pre-rotation process, the total number of rotations of the developing sleeve 41 is changed, and thus, the productivity does not deteriorate. In addition, even if the total number of rotations of the developing sleeve 41 is increased and pre-rotation process is extended in the pre-rotation mode 1, in a case where the toner adhesion to the developing sleeve 41 is less likely to occur, the pre-rotation process is not extended every time since the pre-rotation mode 2 is performed. Therefore, while suppressing generation of the abnormal image, it is possible to suppress deterioration of the productivity.

Second Embodiment

Figure 9:
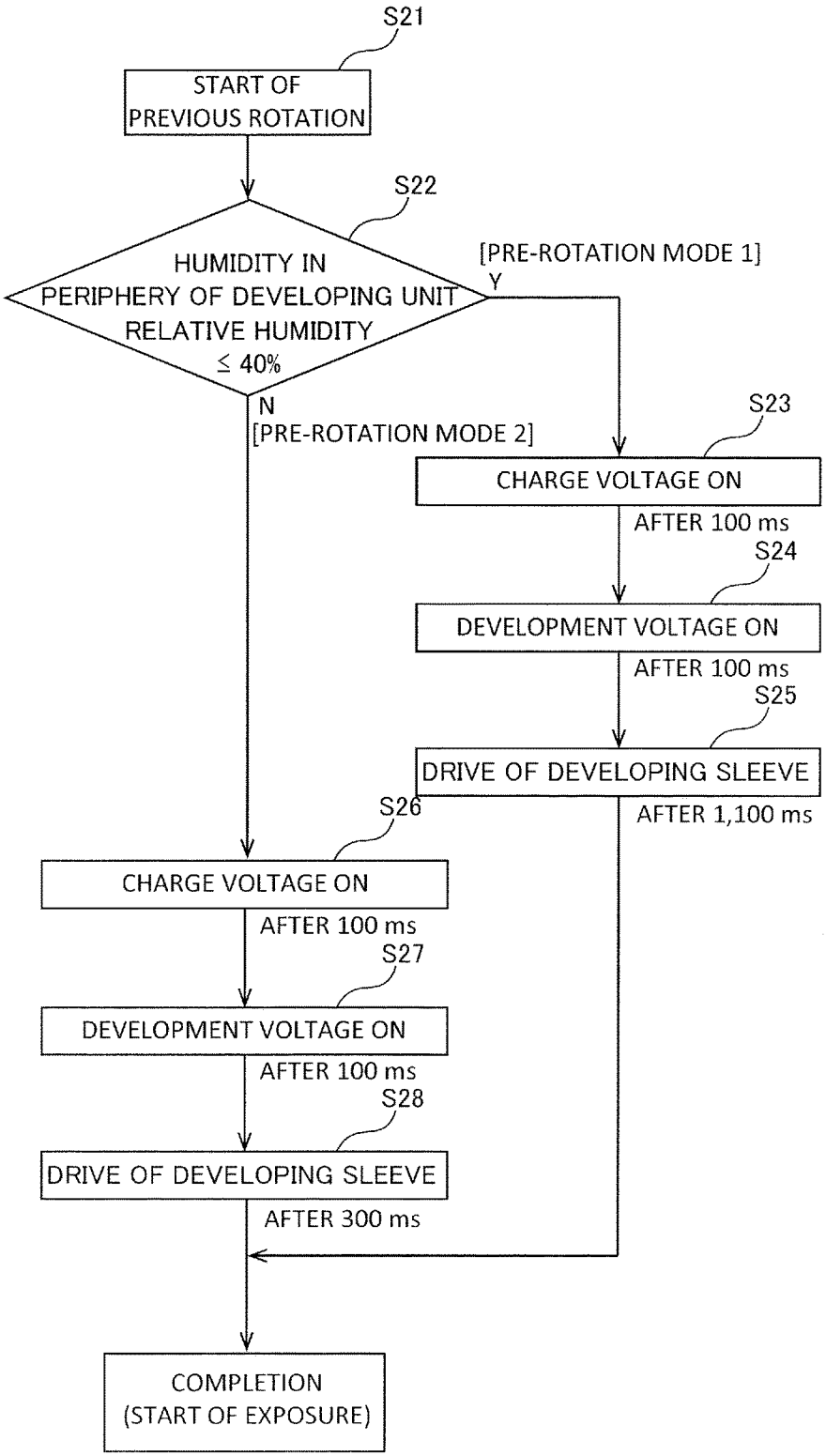
FIG. 9 is a flow chart of rising control of a pre-rotation process according to a second embodiment.

A second embodiment will be described by using FIG. 9 with reference to FIGS. 1 to 3. In the above-described first embodiment, the pre-rotation mode 1 and the pre-rotation mode 2 are switched in accordance with the rotation amount of the developing sleeve 41, but in the embodiment, the switching is performed in accordance with humidity or moisture content in the periphery of the developing unit 4Y as the information which influences the toner charging amount. In particular, in the embodiment, the switching is performed in accordance with relative humidity in the periphery of the developing unit 4Y.

The toner adhesion to the developing sleeve 41 receives the influence on the charging amount of the toner as described above, but the charging amount of the toner receives the influence of the relative humidity of environment where the developing unit 4Y is installed. Since the charging of the toner is performed by the frictional charging of the carrier and the toner, there is a tendency that the charging amount of the toner increases when the humidity is low. It is necessary to control the toner concentration in the developing unit to be high in a case where the charging amount of the toner is high, and as a result, the toner adhesion to the developing sleeve is likely to occur. Therefore, in the embodiment, by detecting the relative humidity in the periphery of the developing unit 4Y, the timing of the start of rotating the developing sleeve 41 is changed in the pre-rotation process in accordance with the detection. In addition, in the environment of low humidity where the sleeve adhesion is likely to occur, the timing of the start of rotating the developing sleeve 41 is set to be early, and the total number of rotations of the developing sleeve 41 is large. On the contrary, in the environment of high humidity where the sleeve adhesion is unlikely to occur, the timing of the start of rotating the developing sleeve 41 is set to be a timing of the start of the rotation immediately before the start of the image formation similar to the normal image formation, and the total number of rotations of the developing sleeve 41 is smaller than that in the pre-rotation mode 1.

In this manner, in the embodiment, as illustrated in FIG. 1, a temperature and humidity sensor 50 which serves as a humidity detection portion is disposed in the apparatus body of the image forming apparatus 100. In addition, the controller 101 switches the pre-rotation mode 1 and the pre-rotation mode 2 in accordance with the relative humidity detected by the temperature and humidity sensor 50 when the image formation is started. In other words, the pre-rotation mode 1 is performed in the case where the relative humidity (predetermined humidity or moisture content) is equal to or lower than predetermined relative humidity (equal to or lower than predetermined humidity or moisture content), and the pre-rotation mode 2 is performed in the case where the relative humidity is higher than the predetermined relative humidity (predetermined humidity or moisture content).

Hereinafter, the rising control in the pre-rotation process of the embodiment will be specifically described. As illustrated in FIG. 9, when the operation of the pre-rotation which is the predetermined operation period before the start of the image formation is started (S21), the controller 101 detects the relative humidity in the periphery of the developing unit 4Y by the temperature and humidity sensor 50. In addition, it is determined whether or not the detected relative humidity is equal to or lower than the predetermined relative humidity (40% in the embodiment), and the mode of the pre-rotation is determined (S22). Next, in the case (Y in S22) where the detected relative humidity is equal to or lower than the predetermined relative humidity (equal to or lower than 40%), it is determined that the sleeve adhesion of the toner is likely to occur, and the process advances to S23 (pre-rotation mode 1). On the contrary, in a case (N in S22) where the detected relative humidity is higher than the predetermined relative humidity (higher than 40%), it is determined that the sleeve adhesion of the toner is unlikely to occur, and the process advances to S26 (pre-rotation mode 2).

It is noted that, in the embodiment, the operation of the pre-rotation is switched by using the relative humidity (40%) as a boundary, but since the value of the humidity of switching changes according to the developer used, the most appropriate value changes in accordance with the developer. In addition, there is a developer in which the charging amount changes in accordance with not the relative humidity but the moisture content in the environment, and at this time, it is possible to obtain similar effects by the switching in accordance with not the relative humidity but the moisture content. In addition, the description of the control after S23 and S26 will be omitted since the processes after S23 and S26 are respectively similar to those after S3 and S6 illustrated in FIG. 5 of the first embodiment.

In the embodiment, the pre-rotation mode 1 and the pre-rotation mode 2 are switched in accordance with the environment in the periphery of the developing unit 4Y. Therefore, similar to the first embodiment, both the suppression of generation of the abnormal image due to the toner adhesion to the developing sleeve 41, and the suppression of deterioration of the developer or deterioration of the service life of the developing unit 4Y, are achieved.

It is noted that the detection by the temperature and humidity sensor 50 may be performed when the previous image formation is completed. In this case, the detection result is stored in the storage portion 103 (refer to FIG. 3), and the controller 101 performs the control in the pre-rotation process described above based on the detection result which is detected by the temperature and humidity sensor 50 and is stored by the storage portion 103 when the previous image formation is completed. In addition, the controller 101 may perform the detection both when the previous image formation is completed and when the current image formation is started, perform the pre-rotation mode 1 in the case where the detection result of at least any one of the cases is equal to or lower than the predetermined relative humidity (equal to or less than 40%), and perform the pre-rotation mode 2 in other cases. Other configurations and operations are similar to those in the first embodiment.

Third Embodiment

Figure 10:
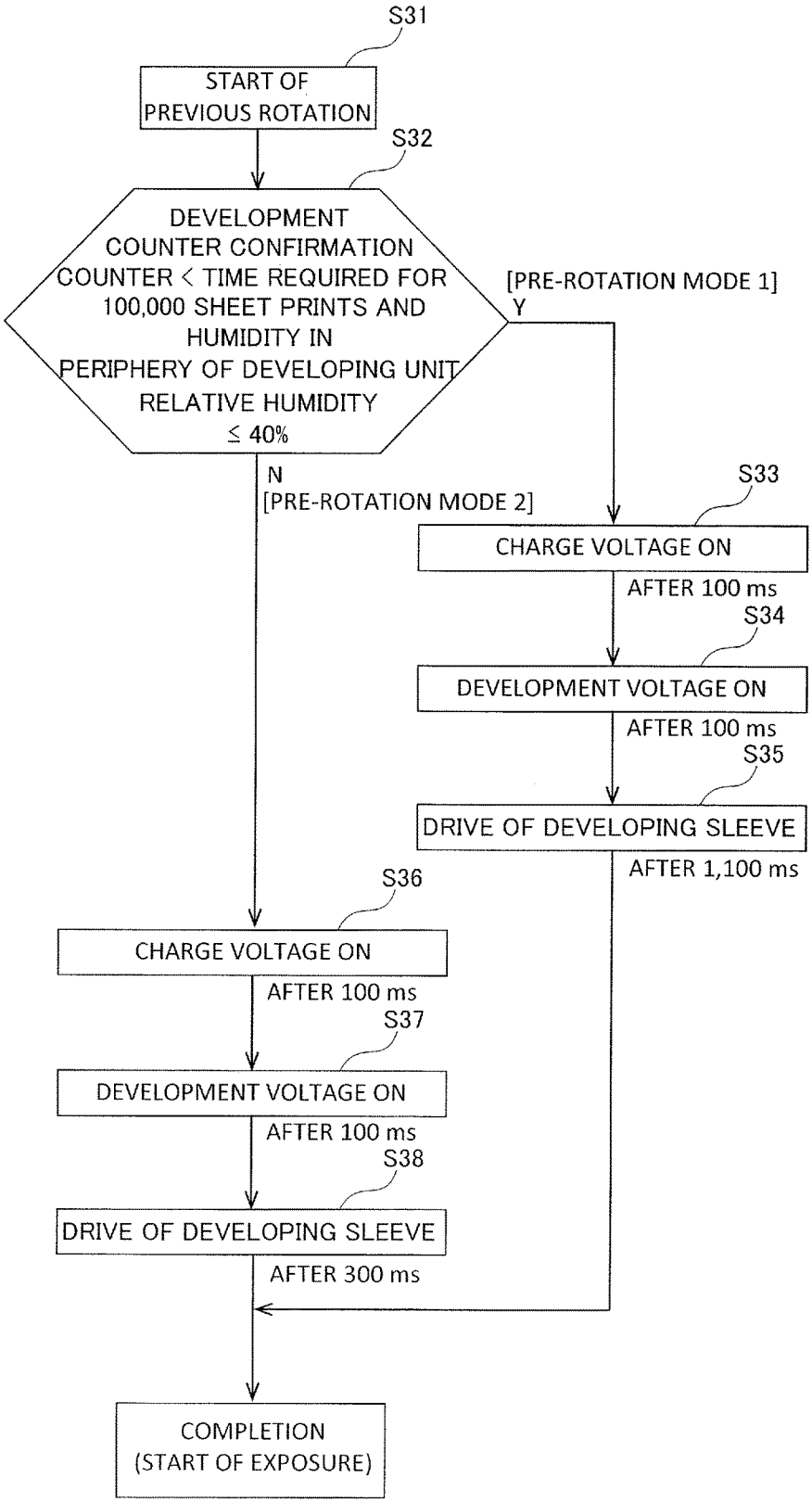
FIG. 10 is a flow chart of rising control of a pre-rotation process according to a third embodiment.

A third embodiment will be described by using FIG. 10 with reference to FIGS. 1 to 3. An example in which the pre-rotation mode 1 and the pre-rotation mode 2 are respectively switched in accordance with the rotation amount of the developing sleeve 41 in the above-described first embodiment, and in accordance with the humidity or the moisture content in the periphery of the developing unit 4Y in the above-described second embodiment, is described. Meanwhile, in the embodiment, the switching is performed in accordance with both the rotation amount of the developing sleeve 41 and the humidity or the moisture content in the periphery of the developing unit 4Y.

Therefore, also in the embodiment, similar to the first embodiment, the storage portion 103 stores an integrated rotation amount (the rotational time) of the developing sleeve 41. In addition, similar to the second embodiment, the temperature and humidity sensor 50 which serves as the humidity detection portion is disposed in the apparatus body of the image forming apparatus 100. In addition, the controller 101 switches the pre-rotation mode 1 and the pre-rotation mode 2 in accordance with the rotation amount (rotational time) stored in the storage portion 103, and the humidity or the moisture content (relative humidity) detected by the temperature and humidity sensor 50 when the image formation is started. In other words, the pre-rotation mode 1 is performed in the case where the rotation amount stored in the storage portion 103 is smaller than the predetermined rotation amount, and the humidity or the moisture content detected by the temperature and humidity sensor 50, is equal to or lower than the predetermined humidity or moisture content. Meanwhile, the pre-rotation mode 2 is performed in other cases.

Hereinafter, the rising control of the embodiment will be specifically described. As illustrated in FIG. 10, when the operation of the pre-rotation which is the predetermined operation period before the start of the image formation is started (S31), the controller 101 obtains the rotational time (counter) of the developing sleeve 41 from the storage portion 103 (development counter confirmation). In addition, the controller 101 detects the relative humidity in the periphery of the developing unit 4Y by the temperature and humidity sensor 50. In addition, it is determined whether or not the counter (rotation amount) is smaller than the predetermined rotational time (predetermined rotation amount) stored in the storage portion 103 in advance. In addition, at the same time, it is determined whether or not the detected relative humidity (humidity or moisture content) is equal to or lower than the predetermined relative humidity (equal to or lower than the predetermined relative humidity or moisture content), and the mode of the pre-rotation is determined (S32). In the embodiment, for example, the predetermined rotational time is also set to be the time equivalent to the time required for 100,000 sheet prints on the sheet having the lateral size of A4. In addition, the predetermined relative humidity is set to be 40%.

Next, in the case (Y in S32) where the counter is smaller than the predetermined number of rotations (smaller than the time required for 100,000 sheet prints), and the detected relative humidity is equal to or lower than the predetermined relative humidity (equal to or lower than 40%), the process advances to S33 (pre-rotation mode 1). In a case where any one of the conditions is not satisfied (N in S32), the process advances to S36 (pre-rotation mode 2). It is noted that the detailed description of the control after S33 and S36 will be omitted since the processes after S33 and S36 are respectively similar to those after S3 and S6 illustrated in FIG. 5 of the first embodiment.

In the embodiment, it is possible to further limit a state where the sleeve adhesion of the toner occurs by the rotational time of the developing sleeve 41 and the environment in the periphery of the developing unit 4Y. As a result, since frequency of performing the pre-rotation mode 1 in which the total number of rotations of the developing sleeve 41 is increased is decreased, it is possible to further suppress deterioration of the developer or deterioration of service life of the developing unit 4Y.

It is noted that the detection by the temperature and humidity sensor 50 may be performed when the previous image formation is completed. In this case, the detection result is stored in the storage portion 103 (refer to FIG. 3), and the controller 101 performs the control in the pre-rotation process described above based on the detection result which is detected by the temperature and humidity sensor 50 and is stored by the storage portion 103 when the previous image formation is completed, and based on the rotation amount (rotational time) stored in the storage portion 103. In addition, the controller 101 may perform the detection both when the previous image formation is completed and when the current image formation is started, perform the pre-rotation mode 1 in the case where the detection result of at least any one of the cases is equal to or lower than the predetermined relative humidity (equal to or less than 40%), and the counter is smaller than the predetermined number of rotations (smaller than the time required for 100,000 sheet prints), and perform the pre-rotation mode 2 in other cases. Other configurations and operations are similar to those in the first and the second embodiments.

Fourth Embodiment

Figure 11:
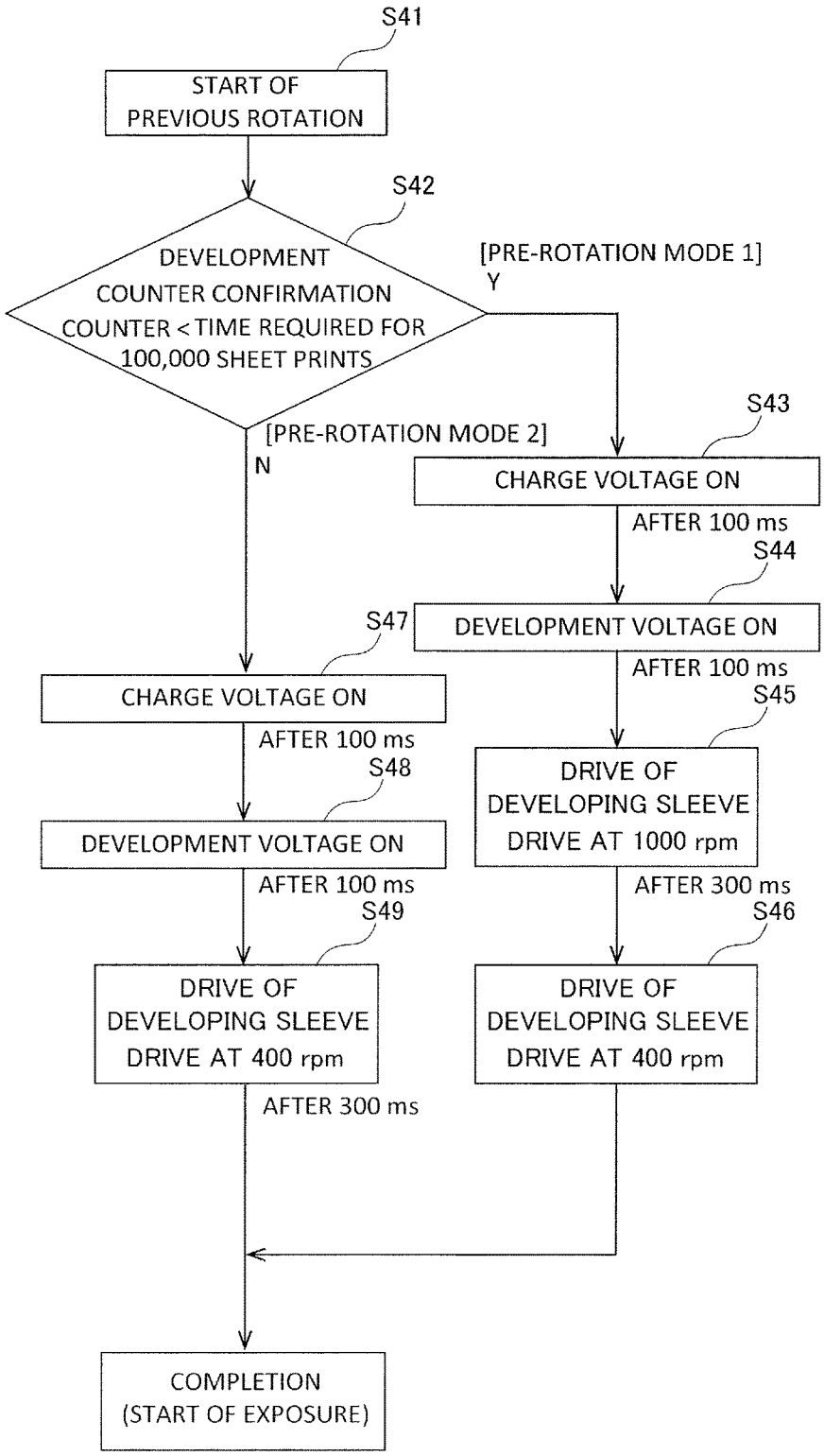
FIG. 11 is a flow chart of rising control of a pre-rotation process according to a fourth embodiment.
Figure 12:
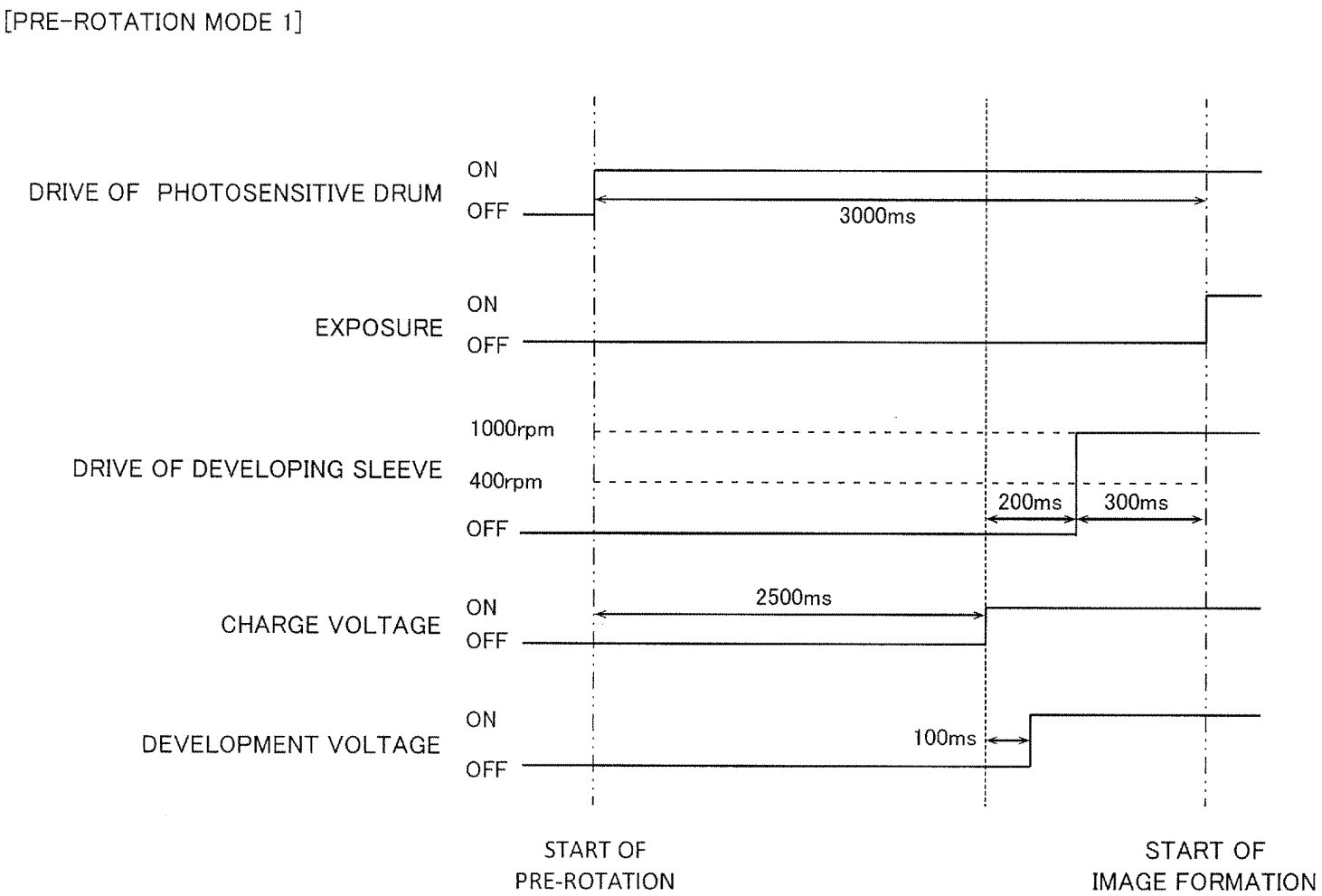
FIG. 12 is a timing chart of rising control of a pre-rotation mode 1 according to the fourth embodiment.
Figure 13:
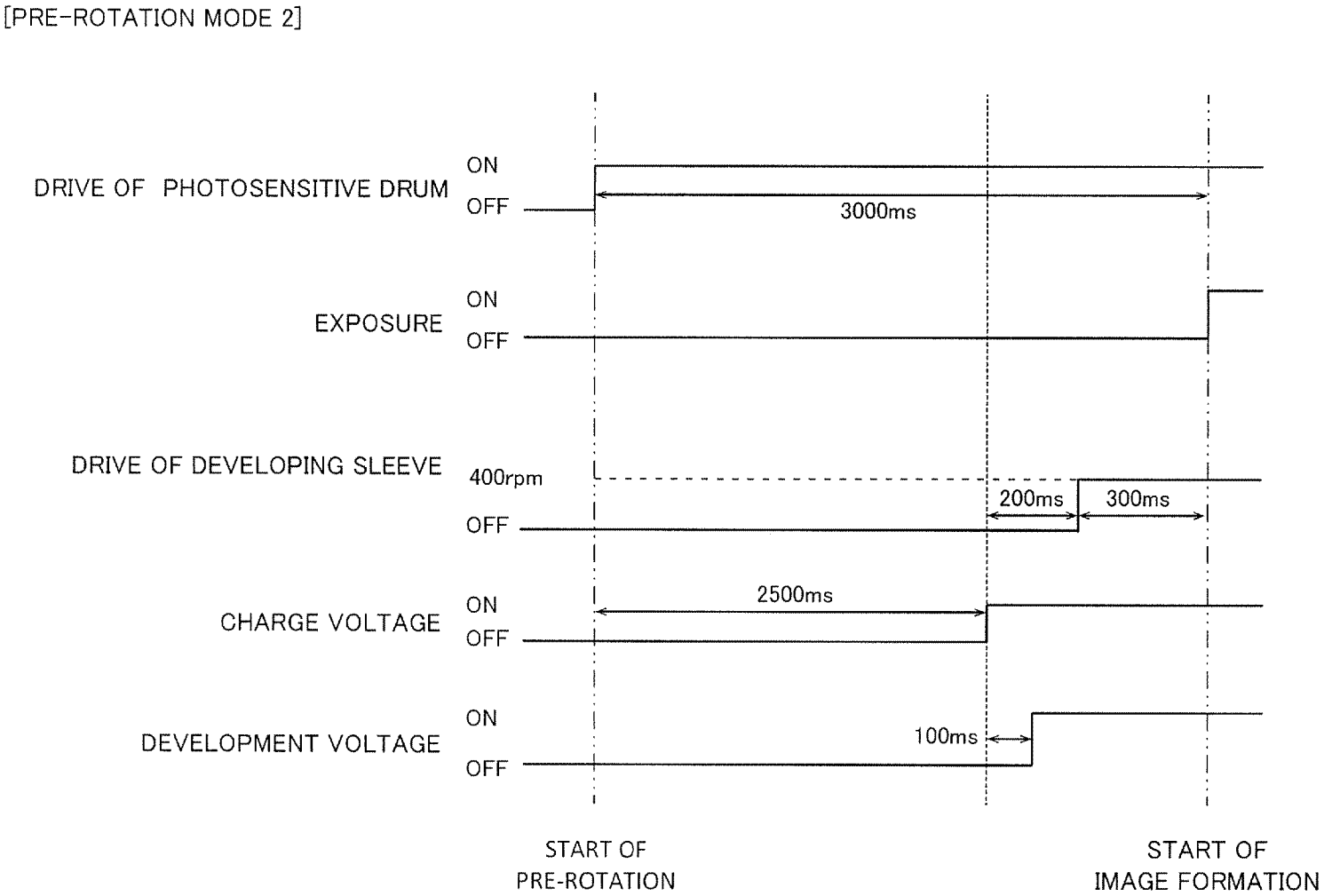
FIG. 13 is a timing chart of rising control of a pre-rotation mode 2 according to the fourth embodiment.

A fourth embodiment will be described by using FIGS. 11 to 13 with reference to FIGS. 1 to 3. In the above-described first to third embodiments, by changing the timing of the start of rotating the developing sleeve 41 in the pre-rotation process, both the suppression of generation of the abnormal image due to the toner adhesion to the developing sleeve 41, and the suppression of deterioration of the developer or deterioration of the service life of the developing unit 4Y, are achieved. Meanwhile, in the embodiment, it is possible to obtain similar effects by the changing the rotational speed of the developing sleeve 41 of the pre-rotation process.

It is noted that, in the embodiment, similar to the first embodiment, the deterioration situation of the developer in the developing unit 4Y is assumed from the rotational time of the developing sleeve 41, and in accordance with this, the rotational speed of the developing sleeve 41 in the operation (pre-rotation process) from the start of the body operation to the start of the image formation is changed. In other words, in the pre-rotation mode 1 which is the first mode of the embodiment, similarly, the rotational speed of the developing sleeve 41 of the pre-rotation process (during the predetermined operation period) is higher than that in the pre-rotation mode 2 which is the second mode.

Therefore, in the embodiment, the storage portion 103 stores an integrated the rotation amount (the rotational time) of the developing sleeve 41. In addition, the controller 101 switches the pre-rotation mode 1 and the pre-rotation mode 2 in accordance with the rotation time stored in the storage portion 103. In other words, the controller 101 can perform the pre-rotation mode 1 and the pre-rotation mode 2. In addition, the pre-rotation mode 1 is performed in the case where the rotation time of the developing sleeve 41 is shorter than the predetermined rotation time, and the pre-rotation mode 2 is performed in the case where the rotation time of the developing sleeve 41 is equal to or larger than the predetermined rotation time.

Hereinafter, rising control in the pre-rotation process of the embodiment will be specifically described. As illustrated in FIG. 11, when the operation of the pre-rotation which is the predetermined operation period before the start of the image formation is started (S41), the controller 101 obtains the information (counter) of the rotational time of the developing sleeve 41 from the storage portion 103 (development counter confirmation). In addition, it is determined whether or not the counter is smaller than the predetermined rotational time stored in the storage portion 103 in advance, and the mode of the pre-rotation is determined (S42). In the embodiment, for example, the predetermined rotation time is set to be the time equivalent to the time required for 100,000 sheet prints on the sheet having the lateral size of A4. Next, in a case (Y in S42) where the counter is smaller than the predetermined rotational time (smaller than the time required for performing the image formation 100,000 times), it is determined that the sleeve adhesion of the toner is likely to occur, and the process advances to S43 (pre-rotation mode 1). On the contrary, in the case (N in S42) where the counter is equal to or larger than the predetermined rotational time (equal to or greater than the time required for 100,000 sheet prints), it is determined that the sleeve adhesion of the toner is unlikely to occur, and the process advances to S47 (pre-rotation mode 2).

Next, a setting method of the rotational speed of the developing sleeve 41 in the rising control in the pre-rotation process after S43 and S47 will be described. As described above, in accordance with the deterioration state of the developer identified in S42, after S43 and S47, the driving speed of the developing sleeve 41 during the pre-rotation is changed.

Pre-Rotation Mode 1

First, the pre-rotation mode 1 (after S43) which is the first mode will be described with reference to FIG. 12. It is noted that FIG. 12 and FIG. 13 which will be described later are timing charts of the start of the rotational drive of the photosensitive drum 1Y (drive of photosensitive drum ON), the start of the exposure by the exposing unit 3Y (exposure ON), the start and the change of the rotational drive of the developing sleeve 41 (drive of developing sleeve of 400 rpm or 1,000 rpm), the start of the application of the charge voltage by the charging roller 2Y (charge voltage ON), and the start of the application of the development voltage by the developing unit 4Y (development voltage ON). In other words, FIGS. 6 and 7 are timing charts of the rising of each portion.

In the pre-rotation mode 1, the application of the charge voltage is started after 2,500 msec from the start of the pre-rotation operation (start of driving the photosensitive drum 1Y) (S43). In addition, the application of the development voltage is started after 100 msec (S44), and further, the drive of the developing sleeve 41 is started after 100 msec after applying the development voltage (S45). In other words, time from the start of rotating the photosensitive drum 1Y to the start of rotating the developing sleeve 41 is 2,700 msec (2,500+100+100, predetermined time). At this time, the rotational speed of the developing sleeve 41 in the pre-rotation process is set to be 1,000 rpm (first rotational speed). In addition, the rotational speed of the developing sleeve 41 is set to be 1,000 rpm only in the pre-rotation process, and immediately before the image forming operation (exposure) is started, the rotational speed of the developing sleeve 41 returns to 400 rpm which is the same as that of the normal image formation (rotational speed when the electrostatic latent image is developed) (S46).

Here, the time from the start of rotating the developing sleeve 41 to the start of the exposure by an exposing unit 3Y is after 300 msec. From the viewpoint of deterioration of the developer in the developing unit 4Y, it is also desirable that the time period during which the developing sleeve 41 rotates from the start of driving the developing sleeve 41 to the exposure is short. However, the time period from the time when the developing sleeve 41 is started to be driven to the time when the rotational speed is stabilized, and a delay of the software signal are added, and the time period during which the developing sleeve 41 rotates from the start of driving the developing sleeve 41 to the exposure is set to be 300 msec. It is needless say that the rotational time of the developing sleeve 41 may not be 300 msec and can be further shortened in a case where a configuration in which the rotational speed rising of the developing sleeve 41 is excellent is employed.

Similar to the above-described first to third embodiments, by making the timing of the start of driving the developing sleeve 41 in the pre-rotation process early, it is also possible to make the toner adhesion of the developing sleeve 41 uniform. However, when the timing of the start of driving the developing sleeve 41 is too early, there is a possibility that the timing of the image formation delays, and at this time, this causes deterioration of the productivity of the body. Here, in the embodiment, in order to make the toner adhesion of the surface of the developing sleeve 41 uniform without deterioration of the productivity, the number of rotations of the developing sleeve 41 in the pre-rotation process is increased. Accordingly, it is possible to make the toner adhesion on the developing sleeve 41 uniform within the determined time period without deterioration of the productivity.

In addition, since the distance from the charge position (a) to the development position (c) illustrated in FIG. 2 is 24 mm, and the rotational speed of the photosensitive drum 1Y is 240 mm/sec, a time lag from the charge position (a) to the development position (c) corresponds to 100 msec. Therefore, in the embodiment, when viewed at the timing at the development position, at substantially the same time as the time when the charge potential becomes ON and the charged surface of the photosensitive drum 1Y reaches the development position, the development potential becomes ON. In addition, the development potential and the drum potential hold the constant relationship.

In this manner, in the pre-rotation mode 1, the rotational speed of the developing sleeve 41 in the pre-rotation process changes from normal speed of 400 rpm to 1,000 rpm, and the rotational speed is set to be higher than the normal speed by 2.5 times. Accordingly, even in the same time period, the total number of rotations by which the developing sleeve 41 rotates in the pre-rotation process is set to be large. As a result, similar to the first to third embodiments, it is possible to increase the frequency of rubbing the toner adhered to the developing sleeve 41 by the developer regulation blade 42 or the developer in the developing unit 4Y, and to make the toner adhered to the developing sleeve 41 uniform.

It is noted that, in the embodiment, the rotational speed of the developing sleeve 41 in the pre-rotation process is set to be 1,000 rpm, but it is desirable that the rotational speed changes in accordance with the configuration or the like of the developing unit 4Y. It is desirable that the developing sleeve 41 is designed to rotate 5 to 30 times until the start of the exposure.

Pre-Rotation Mode 2

Next, the pre-rotation mode 2 (after S47) which is the second mode will be described with reference to FIG. 13. In the pre-rotation mode 2, similar to the pre-rotation mode 1, the application of the charge voltage is started after 2,500 msec from the start of the pre-rotation operation (start of driving the photosensitive drum 1Y) (S47). In addition, the application of the development voltage is started after 100 msec (S48), and further, the drive of the developing sleeve 41 is started after 100 msec after applying the development voltage (S49). In other words, time from the start of rotating the photosensitive drum 1Y to the start of rotating the developing sleeve 41 is 2,700 msec (2,500+100+100, predetermined time) which is the same as that of the pre-rotation mode 1. In this case, similar to the above-described pre-rotation mode 1, by setting the development potential to be ON after 100 msec after setting the charge potential to be ON, the electric field is applied to transfer the toner borne on the developing sleeve 41 to the surface of the developing sleeve 41, and the toner is suppressed from being consumed.

However, in the pre-rotation mode 2, the rotational speed of the developing sleeve 41 in the pre-rotation process is set to be 400 rpm (second rotational speed) which is the same as that of the normal image formation. In the case where the rotational time of the developing sleeve 41 is equal to or larger than the developing sleeve rotational time which corresponds to 100,000 sheet prints, the developer deteriorates, and the toner adhesion to the developing sleeve 41 is unlikely to occur. Therefore, in the pre-rotation mode 2, the rotational speed of the developing sleeve 41 is lower than the rotational speed of the pre-rotation mode 1, and is set to be the same as that of the normal image formation. In other words, the total number of rotations of the developing sleeve 41 in the pre-rotation process is set to be able to be extremely small. It is noted that, both in the pre-rotation mode 1 and the pre-rotation mode 2, the rotational time of the developing sleeve 41 in the pre-rotation process is similarly set to be 300 msec.

In the embodiment, in the pre-rotation mode 1, the rotational speed of the developing sleeve 41 in the pre-rotation process is high, and the total number of rotations of the developing sleeve 41 is large. Meanwhile, in the pre-rotation mode 2, the rotational speed of the developing sleeve 41 in the pre-rotation process is low, and the total number of rotations of the developing sleeve 41 is small. In addition, the pre-rotation mode 1 and the pre-rotation mode 2 are switched based on the information which influences the toner charging amount. Specifically, the pre-rotation mode 1 and the pre-rotation mode 2 are switched in accordance with the rotational time of the developing sleeve 41. Therefore, similar to the first embodiment, both the suppression of generation of the abnormal image due to the toner adhesion to the developing sleeve 41, and the suppression of deterioration of the developer or deterioration of the service life of the developing unit 4Y, are achieved. Other configurations and operations are similar to those in the first embodiment.

Other Embodiments

Each of the above-described embodiments may be carried out by appropriately combining or replacing a portion of the configuration. For example, the rotational speed of the developing sleeve 41 in the pre-rotation process in the fourth embodiment may be switched by the conditions of the second or the third embodiment, that is, the humidity or the moisture content in the periphery of the developing unit. In addition, the change in the total number of rotations of the developing sleeve 41 in the pre-rotation process may be performed by changing the rotational speed of the developing sleeve 41 similar to the fourth embodiment in addition to changing the timing of the start of rotating the developing sleeve 41 similar to the first to the third embodiments. In other words, in the pre-rotation mode 1, the timing of the start of rotating the developing sleeve 41 in the pre-rotation process may be earlier than that in the pre-rotation mode 2, and the rotational speed of the developing sleeve 41 in the pre-rotation process is higher than that of the pre-rotation mode 2.

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-091671, filed Apr. 28, 2015, which is hereby incorporated by reference herein in its entirety.

What is claimed is:

1. An image forming apparatus, comprising:

an image bearing member configured to rotate;

a charging unit configured to charge a surface of the image bearing member;

a latent image forming unit configured to form an electrostatic latent image on the surface of the image bearing member charged by the charging unit;

a developing unit including a developer bearing member configured to rotate and to bear a developer including a toner and a carrier, the developing unit configured to develop the electrostatic latent image formed on the surface of the image bearing member by the toner by applying a development voltage to the developer bearing member; and a controller configured to perform a first mode and a second mode, the first mode being a mode where the developer bearing member rotates in a condition where the image bearing member is charged by the charging unit, and in a condition where the development voltage is applied to the developer bearing member, during a predetermined operation period from a command of an image forming operation until start of forming the electrostatic latent image by the latent image forming unit, the second mode being a mode where the developer bearing member rotates such that a number of rotations is smaller than that in the first mode in a condition where the image bearing member is charged by the charging unit, and in a condition where the development voltage is applied to the developer bearing member, during the predetermined operation period, wherein the controller performs the first mode before a usage amount of the developer bearing member reaches a predetermined value, and performs the second mode in a case where the usage amount of the developer bearing member is equal to or larger than the predetermined value.

2. The image forming apparatus according to claim 1, wherein the usage amount of the developer bearing member is an integrated number of rotations of the developer bearing member.

3. The image forming apparatus according to claim 1, wherein the usage amount of the developer bearing member is an integrated number of times of forming an image onto a sheet having a predetermined size.

4. The image forming apparatus according to claim 1, wherein a rotational speed of the developer bearing member in the first mode is set to be the same rotational speed of the developer bearing member in the second mode, and a rotational time of the developer bearing member in the first mode is set to be longer than a rotational time of the developer bearing member in the second mode.

5. The image forming apparatus according to claim 1, wherein a rotational speed of the developer bearing member in the first mode is set to be higher than a rotational speed of the developer bearing member in the second mode.

6. An image forming apparatus, comprising:

an image bearing member configured to rotate;

a charging unit configured to charge a surface of the image bearing member;

a latent image forming unit configured to form an electrostatic latent image on the surface of the image bearing member charged by the charging unit;

a developing unit including a developer bearing member configured to rotate and to bear a developer including a toner and a carrier, the developing unit configured to develop the electrostatic latent image formed on the surface of the image bearing member by the toner by applying a development voltage to the developer bearing member; and a controller configured to perform a first mode and a second mode, the first mode being a mode where the developer bearing member rotates in a condition where the image bearing member is charged by the charging unit, and in a condition where the development voltage is applied to the developer bearing member, during a predetermined operation period from a command of an image forming operation until start of forming the electrostatic latent image by the latent image forming unit, the second mode being a mode where the developer bearing member rotates such that a number of rotations is smaller than that in the first mode in a condition where the image bearing member is charged by the charging unit, and in a condition where the development voltage is applied to the developer bearing member, during the predetermined operation period, wherein the controller performs the first mode in a case where an absolute moisture content in a periphery of the developing unit is equal to or less than a predetermined value, and performs the second mode in a case where the absolute moisture content in the periphery of the developing unit is higher than the predetermined value.

7. The image forming apparatus according to claim 6, wherein a rotational speed of the developer bearing member in the first mode is set to be the same rotational speed of the developer bearing member in the second mode, and a rotational time of the developer bearing member in the first mode is set to be longer than a rotational time of the developer bearing member in the second mode.

8. The image forming apparatus according to claim 6, wherein a rotational speed of the developer bearing member in the first mode is set to be higher than a rotational speed of the developer bearing member in the second mode.

* * * * *